US007817954B2

(12) United States Patent
Yano et al.

(10) Patent No.: US 7,817,954 B2
(45) Date of Patent: Oct. 19, 2010

(54) CLEANING UNIT, IMAGE CARRIER UNIT INCLUDING SAME, AND IMAGE FORMING APPARATUS INCLUDING SAME

(75) Inventors: Hidetoshi Yano, Yokohama (JP); Osamu Naruse, Yokohama (JP); Naomi Sugimoto, Kawasaki (JP); Kenji Sugiura, Yokohama (JP); Hiroki Nakamatsu, Fujisawa (JP)

(73) Assignee: Ricoh Company Limited, Tokyo (JP)

( * ) Notice: Subject to any disclaimer, the term of this patent is extended or adjusted under 35 U.S.C. 154(b) by 75 days.

(21) Appl. No.: 12/248,364

(22) Filed: Oct. 9, 2008

(65) Prior Publication Data

US 2009/0092428 A1 Apr. 9, 2009

(30) Foreign Application Priority Data

Oct. 9, 2007 (JP) ..... 2007-263837

(51) Int. Cl.
*G03G 21/00* (2006.01)

(52) U.S. Cl. ..... 399/349; 399/350

(58) Field of Classification Search ..... 399/349, 399/350, 351, 353, 354, 98, 99
See application file for complete search history.

(56) References Cited

U.S. PATENT DOCUMENTS

| | | | | |
|---|---|---|---|---|
| 5,765,087 | A | 6/1998 | Yano et al. | 399/344 |
| 6,021,304 | A * | 2/2000 | Sbert et al. | 399/349 |
| 7,078,142 | B2 * | 7/2006 | Itami et al. | 399/350 X |
| 2004/0037599 | A1 * | 2/2004 | Serizawa et al. | 399/350 |
| 2007/0212139 | A1 | 9/2007 | Sugiura et al. | 399/353 |
| 2008/0170878 | A1 | 7/2008 | Yamashita et al. | 399/354 |
| 2008/0193178 | A1 | 8/2008 | Sugimoto et al. | 399/99 |
| 2008/0193179 | A1 | 8/2008 | Sugimoto et al. | 399/354 |
| 2008/0253815 | A1 * | 10/2008 | Yano et al. | 399/353 |

FOREIGN PATENT DOCUMENTS

| | | |
|---|---|---|
| JP | 1-292116 | 11/1989 |
| JP | 3-64604 | 10/1991 |
| JP | 7-33606 | 4/1995 |
| JP | 7-33637 | 4/1995 |
| JP | 10-131035 | 5/1998 |
| JP | 10-310974 | 11/1998 |
| JP | 2002-202702 | 7/2002 |
| JP | 2005-265907 | 9/2005 |
| JP | 2008-96537 | 4/2008 |

OTHER PUBLICATIONS

Machine translation of JP 2008-096537 A dated Feb. 13, 2010.*

* cited by examiner

*Primary Examiner*—Sophia S Chen
(74) *Attorney, Agent, or Firm*—Oblon, Spivak, McClelland, Maier & Neustadt, L.L.P.

(57) ABSTRACT

A cleaning unit, providable to an image carrier unit or an image forming apparatus, includes a cleaning member disposed in contact with a target member to electrically remove residual toner from the target member, an elastic blade disposed in contact with the target member upstream from the cleaning member, a blade supporting member, a blade power source, and a conductive member that is more conductive than the elastic blade, and electrically connects the blade supporting member and the elastic blade. The conductive member is disposed so that an edge part of the conductive member is closer to where the elastic blade contacts the target member than an edge part of the blade supporting member.

13 Claims, 14 Drawing Sheets

CLEANING UNIT, IMAGE CARRIER UNIT INCLUDING SAME, AND IMAGE FORMING APPARATUS INCLUDING SAME

CROSS-REFERENCE TO RELATED APPLICATIONS

The present invention claims priority pursuant to 35 U.S.C. §119 from Japanese Patent Application No. 2007-263837, filed on Oct. 9, 2007 in the Japan Patent Office, the contents and disclosures of which are hereby incorporated by reference herein in their entirety.

BACKGROUND OF THE INVENTION

1. Field of the Invention

Exemplary embodiments of the present invention generally relate to a cleaning unit, an image carrier unit, and an image forming apparatus, and more particularly, to a cleaning unit used in an image forming apparatus such as a copier, a facsimile machine, and a printer, and an image carrier unit that includes the cleaning unit.

2. Discussion of the Related Art

Cleaning units are generally used to remove toner remaining on a surface of a photoconductor after transfer of a toner image therefrom. A blade-type cleaning unit, which is one type of cleaning unit, is known to remove toner with an elastic blade that is made of rubber material.

However, a drawback of blade-type cleaning units is that, when the elastic blade and the photoconductor contact each other with low adhesion, the toner removed from the surface of the photoconductor by the elastic blade is allowed to pass between the surface of the photoconductor and the elastic blade, markedly decrease cleaning ability of the cleaning unit.

To prevent such a drawback, the elastic blade is pressed more or less strongly against the photoconductor, at high contact pressure. However, the high contact pressure to abut the elastic blade against the photoconductor can warp the elastic blade, which can cause a streak-like or a band-shaped cleaning failure. Therefore, it is difficult to maintain stable cleaning performance of the cleaning unit, and in the long term abrasion of a surface film formed on the photoconductor is increased, reducing the service life of the photoconductor.

Recently, high image quality is increasingly demanded, and consequently the size of toner particles used in the developers used to develop images therefore tends to be reduced. Further, reductions in toner manufacturing costs and an increase in a transfer rate of toner are also demanded, and thus an image forming apparatus using spherical toner particles (hereinafter also simply "spherical toner") has been commercialized in which the spherical toner is obtained by forming pulverized or amorphous-shaped toner into a spherical shape using a polymerization method. It is known that use of such small-sized and spherical toner causes cleaning performance to be inferior to that of the pulverized toner in the blade-type cleaning unit.

As a different cleaning unit, an electrostatic cleaning unit employing an electrostatic cleaning method is also used. To perform the electrostatic cleaning method, the electrostatic cleaning unit includes a conductive cleaning member that slidably contacts the surface of the photoconductor and applies a voltage to the conductive cleaning member so as to remove toner from the photoconductor by using electrostatic force as well as sliding frictional force. The electrostatic cleaning unit can achieve good cleaning performance when cleaning the small-sized toner or spherical toner and prevent mechanical sliding contact with the photoconductor to reduce the abrasion of the surface film of the photoconductor.

Further, the above-described electrostatic cleaning unit may include a roller-type cleaning member or cleaning roller that also serves as a conductive cleaning member. In addition to the cleaning roller, a conductive elastic blade may be disposed upstream from a portion where the cleaning roller contacts the photoconductor in a direction of movement of the surface of the photoconductor. The conductive elastic blade is held in contact with the photoconductor and is supplied with a voltage having a polarity opposite that of the cleaning roller.

Residual toner on the surface of the photoconductor has a wide distribution of polarized particles thereon, and therefore the residual toner, which is charged to the same polarity as the cleaning roller, cannot be removed only with a cleaning member to which a voltage of one polarity is applied. However, with the above-described electrostatic cleaning unit, residual toner remaining on the surface of the photoconductor even after the transfer operation receives a charge from the elastic blade when passing a portion where the cleaning blade contacts the photoconductor. Thus, the charged state of the toner may become the same as that on the elastic blade and the opposite of that on the cleaning roller, which is hereinafter referred to as a "toner polarity control." The above-described toner polarity control can efficiently remove the residual toner that has reached a contact position of the cleaning roller and the photoconductor using the cleaning roller, which is supplied with a voltage having a polarity opposite that on the elastic blade.

Although providing good cleaning performance for the small-sized toner or spherical toner, the electrostatic cleaning method cannot remove large amounts of toner all at once, which can result in poor cleaning performance. However, in the above-described electrostatic cleaning unit, the elastic blade is held in contact with the cleaning roller at an upstream side in the direction of movement of the surface of the photoconductor. That is, after the elastic blade has mechanically cleaned the surface of the photoconductor, the cleaning roller may clean the surface thereof. By so doing, the amount of toner conveyed to a portion at which the cleaning roller removes the toner can be reduced, and therefore, even when a large amount of toner is conveyed to the portion, good cleaning performance can be obtained.

A related-art image forming apparatus that employs the above-described cleaning unit applies a voltage to the elastic blade from a power source provided in a main body of the related-art image forming apparatus via a blade supporting member that fixes the elastic blade to the main body of the related-art image forming apparatus. The blade supporting member that is used in such image forming apparatus may be conductive and have high rigidity. The elastic blade supported by the blade supporting member may include a portion that is fixed to the blade supporting member and another, second portion continuous or not with the first portion that is not fixed and freely extends from an end of the blade supporting member to a leading portion thereof contacting the surface of the photoconductor. Whereas the fixed portion is not elastically flexible, the free portion deforms flexibly.

When the free portion is too short, flexible deformation of the elastic blade may be reduced, making the elastic blade incapable of absorbing a tolerance in a gap between the photoconductor and the elastic blade and unable to contact the photoconductor along the axis of the photoconductor, which may degrade the cleaning performance by the elastic blade. If the cleaning performance of the elastic blade degrades, the amount of toner conveyed to the cleaning position of the cleaning roller increases. Since a large amount of toner cannot be removed by the electrostatic cleaning method all at once, poor cleaning performance can be the result. If the gap tolerance is reduced to adapt to an elastic blade that includes a shorter free portion and smaller amount of flexibility, precision of both component dimensions and assembly of the elastic blade and the photoconductor may need to be increased, necessitating increased cost.

Further, as volume resistance of the conductive elastic blade decreases, the voltage of a power source that applies a voltage to the elastic blade can be lowered. However, when an elastic blade that has an extremely low volume resistance is used and the photoconductor has an electrical pinhole on the photoconductor, a current may be supplied from the elastic blade to a base body of the photoconductor via the pinhole. If the current moves from the elastic blade to the base body, the elastic blade cannot be charged, which prevents toner polarity control. Therefore, the elastic blade may need to have a certain minimal volume resistance. As an electrode that applies a voltage to the elastic blade having a certain minimal volume resistance becomes closer to the portion where the elastic blade contacts the photoconductor, the voltage of the power source that applies the voltage to the elastic blade can be set to a lower value.

However, as described above, when a voltage is applied to the elastic blade via the blade supporting member, the blade supporting member may be an electrode to apply the voltage to the elastic blade. If an end portion of the blade supporting member that serves as an electrode is set to become closer to the contact position of the photoconductor and the elastic blade, the free length of the elastic blade may become shorter. With this structure, maintenance of an acceptable level of cleaning performance may lead to an increase in cost.

The above-described problem is not limited to instances in which a photoconductor is a target member to be cleaned by the cleaning unit, but can occur when a target member is any member with a moving surface to which toner can adhere, for example, an image carrier, which includes an intermediate transfer member, and a recording medium conveyance member that conveys a recording medium.

Further, the above-described cleaning unit employs the cleaning roller as a conductive cleaning member, but is not limited thereto. For example, the above-described problem may occur when the cleaning unit employs a cleaning brush that has brush fibers applied with a certain voltage and held in contact with a target member to be cleaned so as to electrostatically remove toner.

SUMMARY OF THE INVENTION

Exemplary aspects of the present invention have been made in view of the above-described circumstances.

Exemplary aspects of the present invention provide a cleaning unit that can effectively remove residual toner remaining on a surface of a target member by meeting a condition that an edge part of a conductive member serving as an electrode is closer to an edge part of a conductive elastic blade than an edge part of a supporting member, so the cleaning unit can operate at a lower voltage while maintaining good cleaning performance.

Other exemplary aspects of the present invention provide an image carrier unit that can include the above-described cleaning unit.

Other exemplary aspects of the present invention provide an image forming apparatus that can include the above-described cleaning unit.

In one exemplary embodiment, a cleaning unit includes a cleaning member disposed in contact with a surface of a target member, supplied with a given voltage with the cleaning member configured to remove residual toner remaining on the surface of the target member by an electrostatic force generated due to the voltage applied to the cleaning member, a conductive elastic blade disposed in contact with the surface of the target member upstream from the cleaning member in a direction of movement of the surface of the target member, a conductive blade supporting member configured to fixedly support the conductive elastic blade to a main body of the cleaning unit, a blade power source configured to apply a given voltage to the conductive elastic blade via the blade supporting member and to charge the residual toner to a same polarity as the voltage applied to the elastic blade while the residual toner passing between the elastic blade and the target member, and a conductive member having conductivity greater than that of the elastic blade, configured to electrically connect the blade supporting member and the elastic blade and deform with the elastic blade while being fixedly attached to a surface of the elastic blade. The conductive member is disposed so that an edge part of the conductive member is closer to where the elastic blade contacts the target member than an edge part of the blade supporting member.

The edge part of the conductive member may be formed on the surface of the elastic blade facing the target member.

The conductive member may include conductive tape attached to the surface of the elastic blade to contact the blade supporting member.

The toner may have a shape factor "SF-1" ranging from approximately 100 to approximately 150.

Further, in one exemplary embodiment, an image carrier unit, which is detachably attachable to an image forming apparatus, includes the above-described cleaning unit and an image carrier configured to serve as the target member. The above-described cleaning unit and the image carrier are integrally provided as a single integrated unit to the image carrier unit.

Further, in one exemplary embodiment, an image forming apparatus includes an image carrier configured to carry an image on a surface thereof, a charging unit configured to charge the surface of the image carrier, a latent image forming unit configured to form an electrostatic latent image on the surface of the image carrier, a developing unit configured to develop the electrostatic latent image formed on the image carrier to a toner image, a transfer unit configured to transfer the toner image on the image carrier onto one of a transfer member and a recording medium, an image carrier cleaning unit configured to remove residual toner remaining on the surface of the image carrier serving as a target member to be cleaned, and the above-described cleaning unit.

The image carrier may include a photoconductive layer formed of amorphous silicon.

The image carrier may include a material having a filler dispersed in a layer thereof.

The image carrier may use an element based on a cross-linking type charge transport material.

The image carrier may includes a surface layer thereof reinforced with filler.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
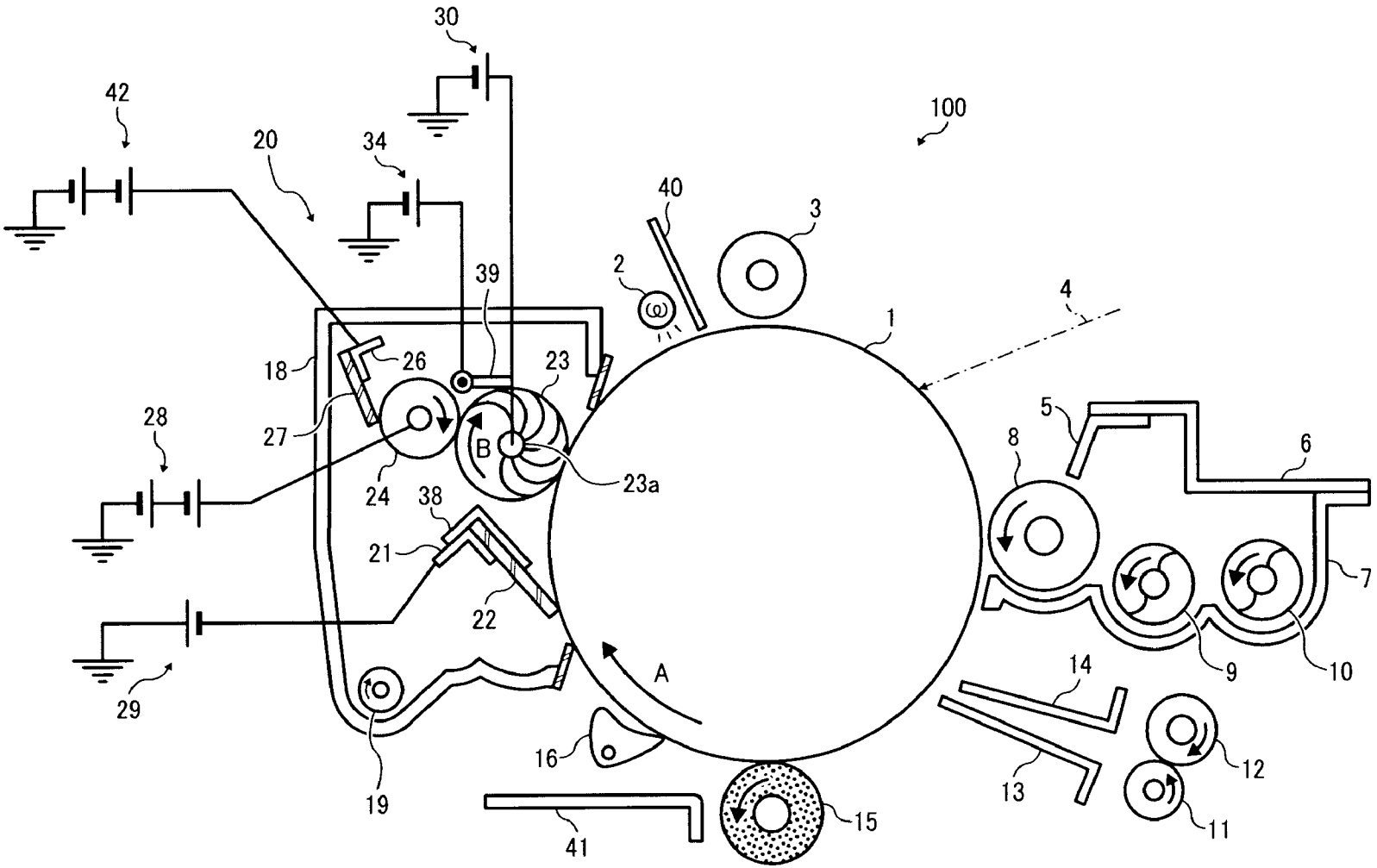
FIG. 1 is a schematic configuration of a printer according to an exemplary embodiment of the present invention.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Exemplary embodiments applied to an electrophotographic printer serving as an image forming apparatus (hereinafter, referred to as a "printer 100") are described in detail below.

Figure 2:
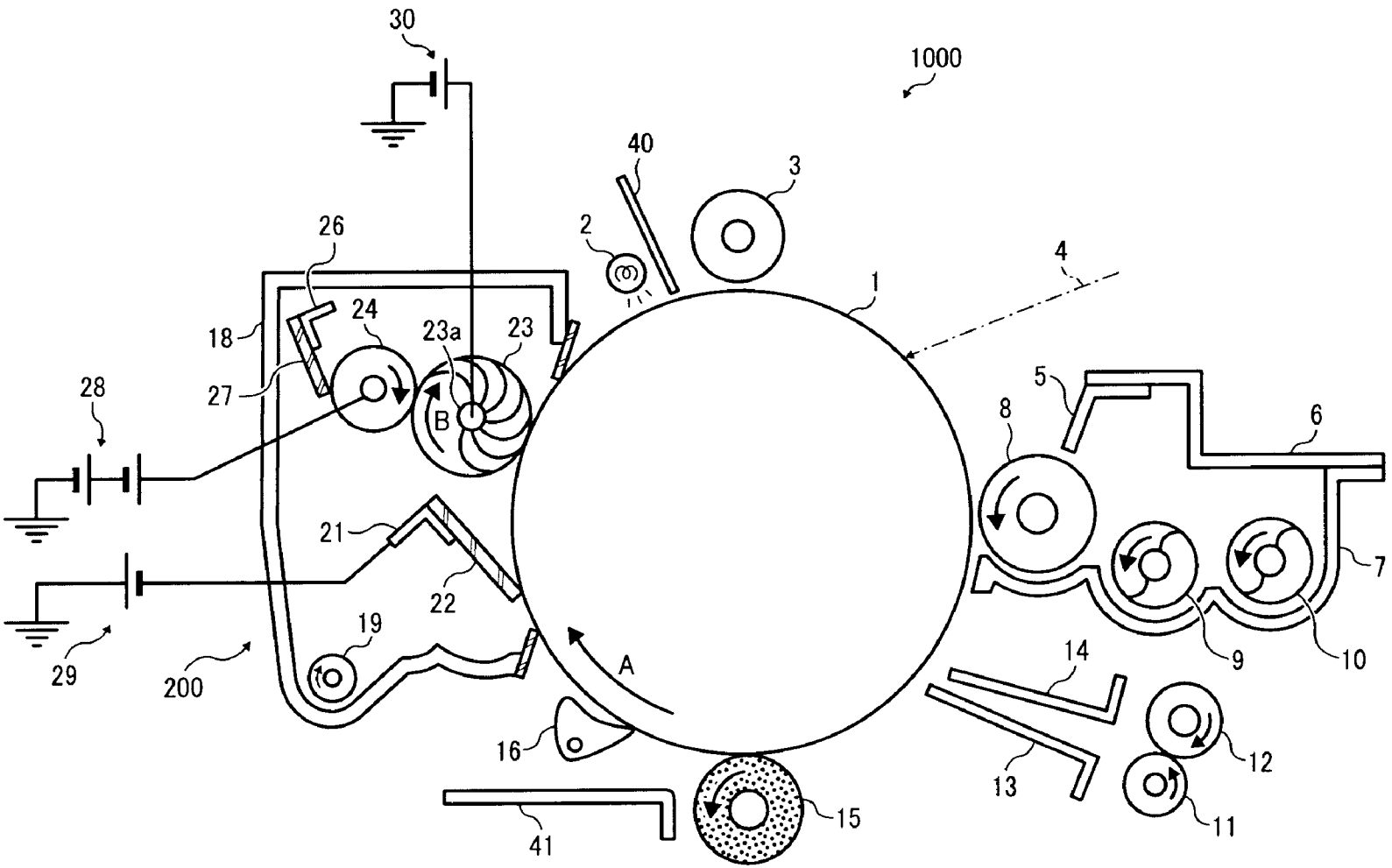
FIG. 2 is a schematic configuration of an example printer.

FIG. 1 is a schematic view illustrating main components of the printer 100 according to exemplary embodiments. FIG. 2 is a schematic view illustrating main components of an example printer 1000. The printers 100 and 1000 form monochrome images based on image data read by an image reading unit, not shown.

The following descriptions are given of features and components of the printer 100 of FIG. 1 commonly used in the printer 1000 of FIG. 2. Since the configurations of the printers 100 and 1000 are similar, the following descriptions are described mainly for the printer 100 of FIG. 1 and elements and members of the printer 1000 of FIG. 2 corresponding to those of the printer 100 of FIG. 1 are denoted by the same reference numerals.

First, an overall configuration of the printer 100 of FIG. 1 according to an exemplary embodiment of the present invention is described.

The printer 100 includes a drum-type photoconductor 1 that serves as an image carrier.

Various image forming components are arranged around the photoconductor 1 are a charging roller 3 serving as a charging unit and a developing unit 6 serving as a developing unit or a toner image forming unit that develops a latent image into a toner image. The various image forming components arranged around the photoconductor 1 further include a transfer roller 15 to transfer the toner image developed by the developing unit 6 onto a transfer sheet serving as a recording medium, a cleaning unit 20 or 200 serving as a cleaning unit that removes residual toner particles remaining on a surface of the photoconductor 1 after the toner image has been transferred onto the transfer sheet, an electrical discharge lamp 2 that electrically discharges the surface of the photoconductor 1, and so forth. A light shielding plate 40 that shields light emitted from the electrical discharge lamp 2 is provided between the electrical discharge lamp 2 and the charging roller 3.

The charging roller 3 is provided apart from the photoconductor 1 by a given or desired distance so as to charge the surface of the photoconductor 1 to a given or desired polarity and a given or desired potential level. For example, the charging roller 3 uniformly charges the surface of the photoconductor 1 to the negative polarity in the printer 100 or 1000.

An exposure device, not shown, irradiates a laser beam 4 to the surface of the photoconductor 1 uniformly charged by the charging roller 3 based on the image data read by the image reading unit, not shown. Accordingly, an electrostatic latent image is formed on the surface of the photoconductor 1.

The developing device 6 includes a developing roller 8 serving as a developer carrier in which a magnet for generating a magnetic field is included. A power source, not shown, applies a developing bias to the developing roller 8. In a casing 7 of the developing device 6, a supply screw 9 and an agitation screw 10, both of which convey a two-component developer including a toner and a carrier stored in the casing 7 in a direction opposite to each other so as to stir or agitate the developer, are provided. The developing device 6 further includes a doctor blade 5 to control an amount of the developer carried by the developing roller 8.

The toner included in the developer agitated and conveyed by the supply screw 9 and the agitation screw 10 is negatively charged. The developer is attracted to the developing roller 8 by an action of the magnet included in the developing roller 8. An amount of the developer attracted to the developing roller 8 is controlled or regulated by the doctor blade 5, and a magnetic force causes the developer to rise in a form of chain segments so as to form a magnetic brush in a developing area facing the photoconductor 1.

A power source, not shown, applies a transfer bias to the transfer roller 15.

Next, image forming operations performed by the printer 100 of FIG. 1 are described in detail below. Image forming operations performed by the printer 1000 of FIG. 2 are similar to the image forming operations performed by the printer 100. Even though descriptions of the image forming operations of the printer 1000 are omitted here, elements and units thereof may perform the same functions as those of the printer 100 of FIG. 1.

In the printer 100, when a start button provided in an operation unit, not shown, is pressed, the image reading unit, not shown, starts reading an original document. A given or desired voltage or current is sequentially applied to the charging roller 3, the developing roller 8, the transfer roller 15, a cleaning brush 23, a polarity control blade 22, a cleaning brush charge imparting member 39, and a toner collection roller 24, respectively, at a given or desired timing. Similarly, a given or desired voltage or current is sequentially applied to a toner collection roller cleaning blade 27 and the electrical discharge lamp 2, at a given or desired timing.

In synchronization with the above-described action, the photoconductor 1 is rotated in a direction indicated by arrow A in FIG. 1 by a photoconductor driving motor, not shown, serving as a driving unit. When the photoconductor 1 is rotated, the charging roller 3, the developing roller 8, the transfer roller 15, the supply screw 9, the agitation screw 10, a toner discharging screw 19 to be described in detail later, the cleaning brush 23, and the toner collection roller 24 are also rotated in a given or desired direction, respectively.

When being rotated in the direction indicated by arrow A in FIG. 1, the surface of the photoconductor 1 is uniformly charged to, for example, an electric potential of −900 V, by the charging roller 3. The exposure device, not shown, irradiates the laser beam 4 corresponding to an image signal to the surface of the photoconductor 1. The electric potential at a portion of the photoconductor 1 irradiated by the laser beam 4 falls to, for example, −150 V, so that an electrostatic latent image is formed on the surface of the photoconductor 1.

The surface of the photoconductor 1 having the electrostatic latent image thereon contacts the magnetic brush formed of the developer on the developing roller 8 at the portion facing the developing device 6. At this time, the negatively charged toner particles on the developing roller 8 are attracted to the electrostatic latent image by a developing bias of, for example, −600 V, applied to the developing roller 8, consequently, a toner image is formed on the surface of the photoconductor 1. As described above, in the exemplary embodiment, the electrostatic latent image formed on the surface of the photoconductor 1 is developed with the toner negatively charged by the developing device 6 by using a reversal developing process, also known as a negative-positive developing process, in which the toner is adhered to a portion of the electrostatic latent image having a lower electric potential.

As described above, this exemplary embodiment of the present invention uses the negative-positive developing process with a non-contact charging roller. However, the present invention is not limited to the above-described process with the above-described member, but instead, includes different processes and members.

The transfer sheet supplied from a sheet feeding unit, not shown, is conveyed through a portion between an upper registration roller 11 and a lower registration roller 12 in synchronization with a leading edge of the toner image formed on the surface of the photoconductor 1. Subsequently, the transfer sheet is guided by guide plates 13 and 14. When the transfer sheet is conveyed through a transfer area formed between the photoconductor 1 and the transfer roller 15, the toner image formed on the surface of the photoconductor 1 is transferred onto the transfer sheet. When the toner image is transferred onto the transfer sheet, a transfer bias of, for example, +10 μA under a constant current control, is applied to the transfer roller 15.

The transfer sheet having the transferred toner image thereon is detached from the photoconductor 1 by a separation pick 16, and is guided by a conveyance guide plate 41 to a fixing device, not shown. When the transfer sheet passes through the fixing device, heat and pressure are applied to the transfer sheet so that the toner image is fixed thereto. Thereafter, the transfer sheet is discharged from the printer 100.

Meanwhile, after the toner image formed on the surface of the photoconductor 1 has been transferred to the transfer sheet, residual toner particles remaining on the surface of the photoconductor 1 are removed by the cleaning unit 20. Thereafter, the surface of the photoconductor 1 is discharged electrically by the electrical discharge lamp 2.

Prior to describing the cleaning unit 20 to remove the residual toner particles on the surface of the photoconductor 1, an example cleaning unit using a blade cleaning method is described in detail below.

As shown in FIGS. 1 and 2, the cleaning unit 20 or 200 includes components and unit in a housing 18, and the components, for example, the cleaning brush 23 that is a brush roller applied with a positive voltage from a brush power source 30 that serves as a brush-roller voltage applying unit. Further, the conductive polarity control blade 22 that serves as a conductive elastic blade applied with a negative voltage from a blade power source 29 is arranged at a location opposite to the surface of the photoconductor 1 in the upstream side of a position where the cleaning brush 23 removes the toner from the photoconductor 1 in the direction of movement of the surface thereof.

The cleaning brush 23 is a brush roller that rotates around a core bar 23*a* in a direction indicated by arrow B, and the brush power source 30 applies a voltage to the core bar 23*a*.

The charge amount of the toner as the residual toner that adheres to the surface of the photoconductor 1 and reaches the opposed portion to the cleaning unit 20 will be explained below.

Figure 3:
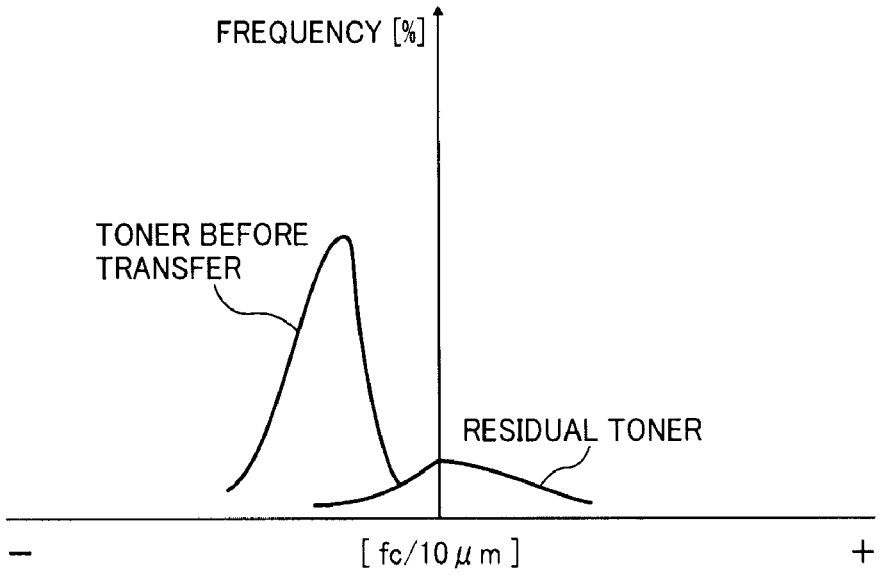
FIG. 3 is a graph representing a charge potential distribution of toner carried on a photoconductor right before transfer thereof and a charge potential distribution of "residual toner after transfer" remaining on a surface of the photoconductor after a toner image is transferred.

FIG. 3 is a graph representing a charge potential distribution (toner q/d distribution) of toner carried on the photoconductor 1 right before transfer thereof and a charge potential distribution of the residual toner remaining on the surface of the photoconductor 1 after a toner image is transferred. It is noted that the charge amount distribution was measured by E-SPART Analyzer manufactured by Hosokawa Micron Corp. In the graph, the vertical axis represents a ratio with respect to the number of collected toner particles, and the horizontal axis represents the charge amount of one toner particle. The number of collected toner particles this time is set to 500 because of a small number of "residual toner particles after a toner image is transferred" (hereinafter, referred to as "residual toner particles").

As shown in FIG. 3, most of the toner particles on the surface of the photoconductor 1 before transfer are charged to the negative polarity. Most of the toner particles charged to the positive polarity before transfer adhere to the photoconductor 1 as they are upon transfer. Further, even if the toner particles are charged to the negative polarity before transfer, the charge polarity may sometimes be reversed to the positive polarity due to injection of charge with the positive polarity applied to the transfer roller 15. Consequently, as shown in FIG. 3, the residual toner particles on the surface of the photoconductor 1 are distributed in such a manner that toner particles with the positive polarity and toner particles with the negative polarity are mixed.

The residual toner particles that adhere to the surface of the photoconductor 1 pass through the opposed portion to the transfer roller 15 and reach an opposed position to the polarity control blade 22 through movement of the surface thereof.

Figure 4:
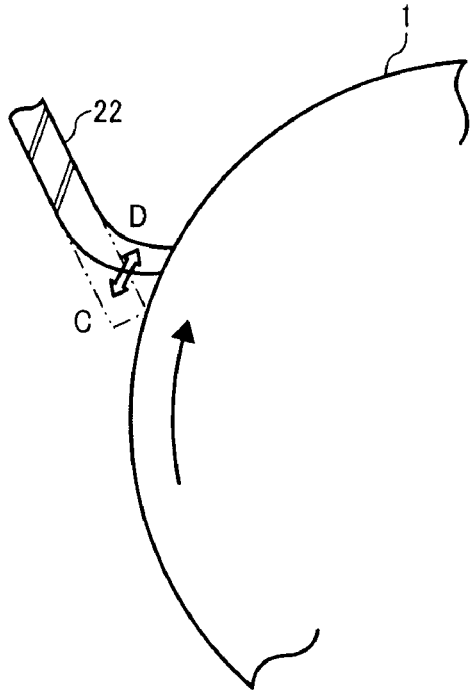
FIG. 4 is a schematic configuration for explaining a cleaning blade when the surface of the photoconductor moves.

FIG. 4 is a schematic structure for explaining the polarity control blade 22 during movement of the surface of the photoconductor 1. Most of the residual toner particles having reached the opposed position to the polarity control blade are mechanically scraped off by the polarity control blade 22. However, as shown in FIG. 4, a so-called stick-slip motion occurs when the polarity control blade 22 is cleaning the surface of the photoconductor 1, and part of the residual toner particles passes through the opposed position to the polarity control blade 22. Specifically, a leading edge of the polarity control blade 22 contacting the photoconductor 1 moves reciprocally between directions "C" and "D", which is the stick slip motion.

A voltage with the negative polarity (e.g., −200 volts) that is same as the charge polarity of the toner is applied to the polarity control blade 22. When the residual toner passes through the opposed portion between the polarity control blade 22 and the photoconductor 1, the charge is injected to the toner. Specifically, when the toner passes through the opposed portion between the polarity control blade 22 and the photoconductor 1, the polarity control blade 22 charges the toner to normal charge polarity, which is a negative polarity.

The toner charged to the normal charge polarity is moved to a position in which the cleaning brush 23 removes the toner from the photoconductor 1 through movement of the surface of the photoconductor 1. As shown in FIG. 1, a voltage (e.g., +600 volts) with the opposite polarity or positive polarity to the charge polarity of the toner is applied to the cleaning brush 23, and the cleaning brush 23 thereby electrostatically attracts the toner having passed through the opposed portion between the polarity control blade 22 and the photoconductor 1.

The toner having moved to the cleaning brush 23 further moves to the toner collection roller 24 by means of a potential gradient, the toner collection roller 24 being applied with a voltage with the positive polarity (e.g., +900 volts) higher than that of the cleaning brush 23 by a collection power source 28. The toner having moved to the toner collection roller 24 is scraped off by the toner collection roller cleaning blade 27, and is discharged by the toner discharging screw 19 to the outside of the cleaning unit 20 or returned to the inside of the developing unit 6.

Details how the charge polarity of the toner changes will be explained below. Specifically, the change occurs while the toner is passing through the conductive polarity control blade 22 applied with the voltage with the same polarity, which is a negative polarity, as that of the toner.

The polarity control blade 22 has an electrical resistance of $1\times10^6$ Ω·cm to $1\times10^8$ Ω·cm and a linear pressure at a contact portion with the photoconductor 1 of 20 g/cm to 40 g/cm, and is configured so as to contact the photoconductor 1 in a counter direction. If the voltage is not applied to the polarity control blade 22, the toner passing through the polarity control blade 22 is frictionally charged by pressure of the contact portion between the photoconductor 1 and the polarity control blade 22. Then, a charge potential distribution of the toner shifts to the normal charge polarity (negative polarity) side of the toner.

Figure 5:
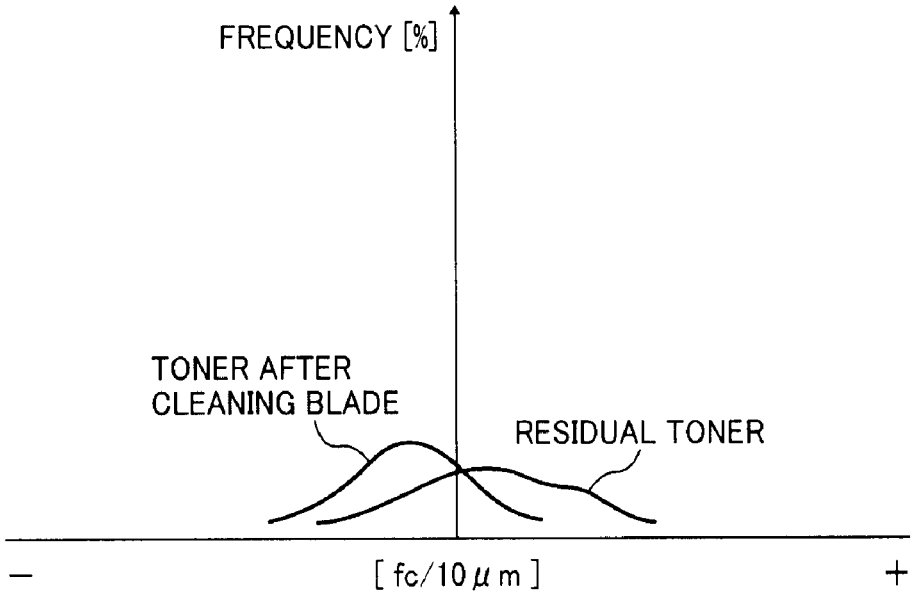
FIG. 5 is a graph representing a charge potential distribution of toner carried on the photoconductor after toner thereof and a charge potential distribution of residual toner after transfer having passed through an opposed portion to the cleaning blade.

FIG. 5 is a graph representing a charge potential distribution of toner carried on the photoconductor 1 after transfer thereof and a charge potential distribution of the residual toner having passed through the opposed portion to the polarity control blade 22. The toner having passed through the opposed portion to the polarity control blade 22 is slightly charged to the negative polarity, and shifts to the normal charge polarity side of the toner. Despite this, the distribution represents a mixture of the toner with the positive polarity and the toner with the negative polarity.

The charge amount distribution of the residual toner is broad as shown in FIG. 5, and thus, all the residual toner particles are not always charged to the normal charge polarity.

Therefore, any measures other than frictional charge are required to change the charge polarity of all the residual toner particles to normal polarity.

Besides, as shown in FIG. 4, the so-called stick-slip movement occurs in such a manner that the contact state of the polarity control blade 22 with the photoconductor 1 changes to the direction of rotation of the photoconductor 1. When the conductive polarity control blade 22 moves to a state indicated by "C" of FIG. 4, then the toner passes therethrough.

As shown in FIGS. 1 and 2, if a negative voltage is applied to the polarity control blade 22 and when the toner is held between the polarity control blade 22 and the photoconductor 1, electrical current flows into the toner with the voltage applied to the polarity control blade 22. The toner is thereby charged to the polarity of the applied voltage side, to pass through the contact portion between the polarity control blade 22 and the photoconductor 1. The toner is also charged to the polarity same as that of the applied voltage by means of micro-discharge at a fine gap portion between an entrance and an exit of a wedge portion formed with the photoconductor 1 and the polarity control blade 22.

The polarity control blade 22 of the cleaning unit 20 according to this exemplary embodiment shown in FIG. 1 and the polarity control blade 22 of the cleaning unit 200 shown in FIG. 2 are different in the following point. That is, the cleaning unit 20 of FIG. 1 creates a conduction state between the blade holder 21 and the polarity control blade 22 by using conductive tape 38, which will be described later, while the cleaning unit 20 of FIG. 2 does not include the conductive tape 38.

Figure 6:
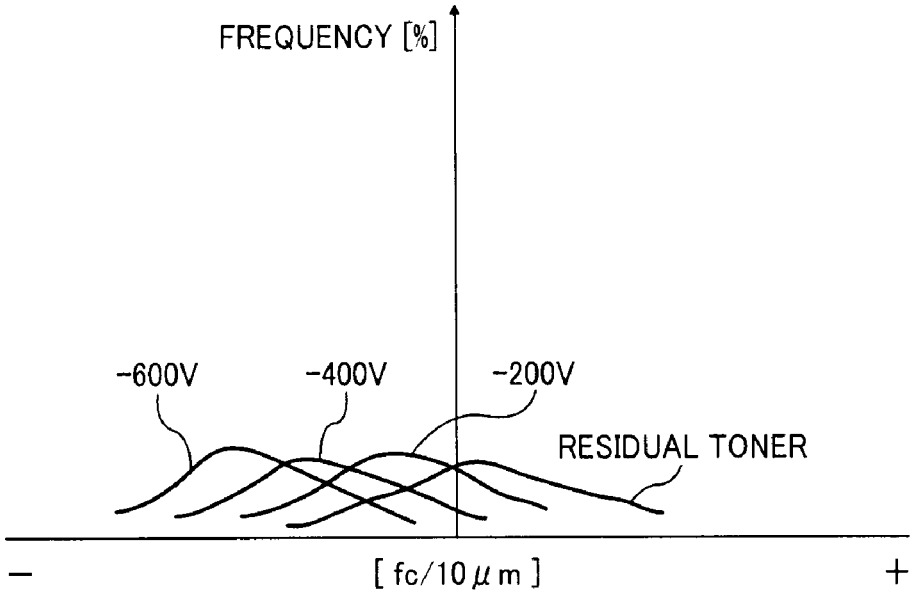
FIG. 6 is a graph representing changes of a charge potential distribution of residual toner after transfer when a voltage applied to the cleaning blade is changed.

FIG. 6 is a graph representing changes of a charge potential distribution (toner q/d distribution) of the residual toner when the voltage applied to the polarity control blade 22 is changed. In the printer 1000 shown in FIG. 2, an overhang length of the polarity control blade 22 from the blade holder 21 is 7 mm. The toner passing through the contact portion between the polarity control blade 22 and the photoconductor 1 shifts to the normal charge polarity of the toner due to "frictional charge", "charge injection", "electrical discharge", and so forth caused by the photoconductor 1 and the polarity control blade 22. At this time, as shown in FIG. 6, the toner shifts to the normal charge polarity of the toner according to an increase in the voltage applied to the polarity control blade 22.

It has been confirmed that the surface potential of the photoconductor 1 after transfer of the toner image varies according to transfer conditions, in an approximate range from −100V to +300V. That is, if a voltage supplied to the polarity control blade 22 shown in FIG. 6 is −200V, when the surface potential of the photoconductor 1 reaches +300V, a potential difference is 500V and electrical discharge has already begun. However, the amount of the electrical discharge is still small, and therefore it is contemplated that the toner polarity inversion is mainly caused by charge injection and not yet affected by the electrical discharge.

Further, when the voltage supplied to the polarity control blade 22 becomes higher, electrical discharge can occur at a small gap between an inlet and an outlet in a wedge-shaped part formed by the photoconductor 1 and the polarity control blade 22, which may cause the toner to be charged to the same polarity as the applied voltage. After being charged to the polarity identical to the applied voltage and passing the portion where the polarity control blade 22 and the photoconductor 1 contact each other, the toner is electrostatically removed by the cleaning brush 23 that is applied with a voltage opposite to the toner charge polarity. By scraping off the toner mechanically, the wedge-shaped part on the inlet side of the contact portion of the polarity control blade 22 and the photoconductor 1 may be contaminated by the toner. Therefore, the electrical discharge in the small gap may be mainly generated at the outlet side of the wedge-shaped part.

The polarity control blade 22 is an elastic member formed of a material such as polyurethane rubber and is given conductivity. The thickness thereof is in a range of from 1.5 mm to 3 mm, preferably in a range of from 2 mm to 2.5 mm.

If the thickness is too thin, it is difficult to ensure the linear pressure of the polarity control blade 22 to the photoconductor 1 due to distortion of the surface of the photoconductor 1 and of the polarity control blade 22 itself. By contrast, if the thickness is too thick, the linear pressure to the contact depth largely changes, and control of the linear pressure becomes thereby difficult, which results in a high linear pressure with respect to a target linear pressure and acceleration of wear of the polarity control blade 22.

The polarity control blade 22 of the cleaning unit 20 comes in contact with the photoconductor 1 in the counter direction, and a contact angle is 20 degrees, a contact pressure is 20 g/cm, and a contact depth to the photoconductor 1 is 1 millimeter. An electrical resistance thereof is set to $1\times10^6$ Ω·cm. The electrical resistance is preferably from $1\times10^6$ Ω·cm to $1\times10^8$ Ω·cm.

The polarity control blade 22 is formed of a plate bonded to a blade holder 21 (sheet metal), and a thickness is 2 mm, a free length is 7 mm, a JIS-A hardness is 60 to 80, and impact resilience is 30%, however, any other values are also possible. For example, the JIS-A hardness can be in a range from 40 to 85. This is because there is no problem with slight increase or decrease in the amount of toner passing through the polarity control blade 22 caused by imperfect cleaning of the toner by the polarity control blade 22.

A cleaning unit provided in an image forming apparatus before the printer 1000 as shown in FIG. 2 will be explained below.

The image forming apparatus is required to have high resolution so as to be capable of forming higher resolution and higher definition images. One of units or devices to achieve these requirements is to use toner with a smaller particle size. Besides that, more spherical toner is increasingly used rather than toner with an amorphous shape to improve a transfer rate. However, if the small-sized toner or the spherical toner is cleaned by a related-art cleaning method, the toner may easily pass through the blade due to its small size or its spherical shape, and thus cleaning failure may occur, which causes the cleaning to be difficult.

However, image quality is enhanced by using the small-sized toner and the spherical toner, and thus a cleaner-less system or the like is proposed to use these toners.

Even when the spherical toner is cleaned by the blade cleaning system, it is possible to clean the spherical toner if the linear pressure is set to be extremely high (specifically, linear pressure is 100 gf/cm or greater), however, life of the photoconductor and the cleaning blade may become extremely shorter accordingly. The life of the photoconductor (life when the photoconductive layer is worn to approximately ⅓) with an ordinary linear pressure (20 g/cm) is approximately 100,000 sheets if ϕ30, and the life of the cleaning blade (life when it is scraped and this causes a cleaning failure to occur) is approximately 120,000 sheets.

On the other hand, in the case of the high linear pressure (100 gf/cm), the life of the photoconductor is approximately 20,000 sheets, and the life of the cleaning blade is approximately 20,000 sheets.

It is well known that the blade-cleaning performance for the spherical toner which is said excellent in transfer capability is inferior to the cleaning performance for pulverized or abnormally shaped toner. By contrast, a brush cleaning system is a cleaning system that reduces the abrasion or wear of the surface of the photoconductor and has reliable cleaning performance even in cleaning of the small-sized toner or the spherical toner.

The brush cleaning system is configured to arrange a cleaning brush so as to contact and rub the surface of the photoconductor with the cleaning brush, arrange a toner collection roller provided in contact with the cleaning brush, and remove toner from the toner collection roller by a cleaning member such as a rubber blade. A voltage is supplied to the toner collection roller, or to both the toner collection roller and the brush, and cleaning is performed by means of electrostatic force, and thus the system is effective when the spherical toner is used.

Generally, in a transfer process, a voltage with opposite polarity to that of toner after developing is applied to the toner, and thus toner remaining on the photoconductor 1 after transfer contains a mixture of toner with the same polarity as that of toner after being developed and toner charged to the opposite polarity, or uncharged toner. As means to clean the mixture of the toner with both polarities and the uncharged toner, Japanese Patent Application Laid-open No. 2005-265907 describes the method of controlling the charge amount of toner before being cleaning using a corotron charging system in which a voltage is applied to a corotron charger, arranging two brushes to which voltages with positive polarity and negative polarity are applied respectively, and cleaning the toner with each polarity.

As is the cleaning unit described in Japanese Patent Application Laid-open No. 2005-265907, arrangement of the two brushes opposite to a photoconductor and arrangement of collection units for toner adhering to the respective brushes are quite difficult to achieve a task of minimizing the size of the image forming apparatus. The diameter of a photoconductor tends to be smaller to achieve a recent purpose of minimizing the size of an image forming apparatus, and the cleaning unit also has a task of space saving to meet the purpose. In contrast to the system having the double brushes and the toner collection rollers for the respective brushes, there is a system as follows to further minimize the system. In the system, a polarity control blade applied with a voltage is arranged and an electrostatic cleaning unit is arranged in the downstream side thereof, and the charge polarity of the residual toner is made uniform to one side by the polarity control blade and is cleaned by the electrostatic cleaning unit.

There is a system of using two rollers provided in the electrostatic cleaning unit. One of the rollers is a brush roller of which core bar is electrically floated and the other one is a low resistance toner collection roller applied with a high voltage. With these rollers, a potential difference is formed between the two rollers, causing toner to adhere to the brush roller from an image carrier, and then collecting the toner into the toner collection roller. However, this system has a problem that the potential of the cleaning brush having been floated becomes unstable, which causes the potential difference between the two rollers to become unstable, and the toner cannot be stably collected. This can cause the toner to be deposited on the brush roller as a result of use over time, the toner deposited on the brush roller re-adheres to the photoconductor, and the cleaning performance thereby decreases.

In the cleaning unit 20 provided in the printer 100 of FIG. 1 and the cleaning unit 200 provided in the printer 1000 of FIG. 2, a voltage is applied to the core bar 23*a* of the cleaning brush 23 formed of the brush roller, and a voltage is also applied to the shaft of the toner collection roller 24, to thereby stabilize the potential between the cleaning brush 23 and the toner collection roller 24. Moreover, the cleaning brush 23 has conductive brush fibers each of which an inner portion is formed of a conductive material and a surface thereof is formed of an insulating material. The conductive brush fiber is processed to be inclined, and the brush portion contacting the photoconductor 1 is provided as an insulated portion, so that the cleaning performance is improved.

The cleaning brush 23 in the cleaning unit 20 of the printer 100 will be explained below. Specifically, the cleaning brush 23 electrostatically removes the residual toner having passed through the contact portion between the polarity control blade 22 and the photoconductor 1.

Figure 7:
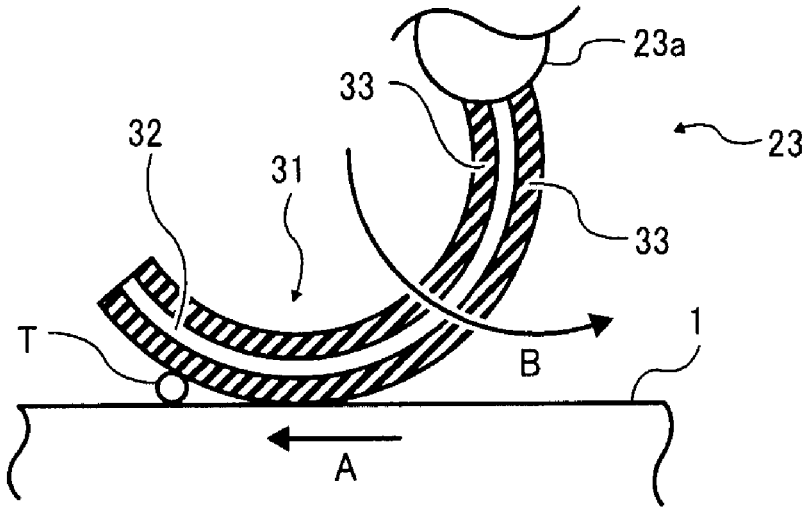
FIG. 7 is a vertical cross-sectional view of a brush fiber of the cleaning brush according to an exemplary embodiment.

FIG. 7 is a vertical cross-sectional view of a brush fiber 31, contacting the photoconductor 1 rotating in a direction indicated by arrow A, of the cleaning brush 23 provided in the cleaning unit 20 of the printer 100. The brush fiber 31 of the cleaning brush 23 has a double-layered core sheath structure in which the inner side thereof is made of a conductive material 32 and the surface portion thereof is made of an insulating material 33. Because the brush fiber 31 with the core sheath structure has a surface layer being the surface portion made of the insulating material 33, the conductive material 32, and the toner do not contact each other except in the cut face of the fiber. Consequently, it is possible to prevent charging to the toner that is removed from the cleaning brush 23.

Further, the brush fiber 31 is inclined or belt in such a manner that the fiber is bent backward in a direction of rotation of the cleaning brush 23 as indicated by arrow B in FIG. 7.

A case where a brush fiber 31A is straight will be explained below.

Figure 8:
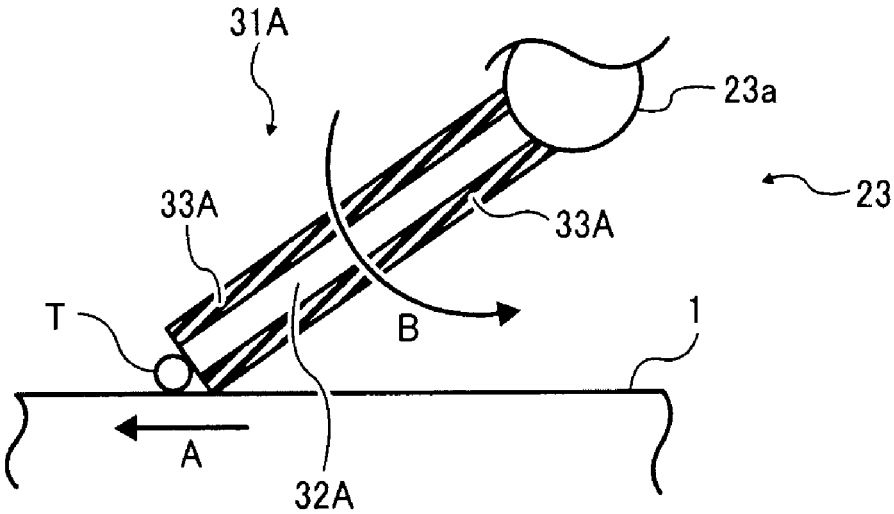
FIG. 8 is a vertical cross-sectional view of the brush fiber of the cleaning brush when the brush fiber is straight.

FIG. 8 is a vertical cross-sectional view of the brush fiber 31A when it is straight, or when the brush fiber 31A having the core sheath structure formed of the inner side thereof being a conductive material 32A and the surface portion thereof being an insulating material 33A is radially fixed to the core bar 23*a* that serves as a rotating shaft of the brush. Arrow A in FIG. 8 represents a rotational direction of the photoconductor 1, and arrow B in FIG. 8 represents a rotational direction of the cleaning brush 23 or movement direction of the brush fiber 31A. If the brush fiber 31A is straight as shown in FIG. 8, the conductive material 32A and a toner particle T contact each other in the section of the tip of the brush fiber 31A, and this may cause charge from the cleaning brush 23 to the toner.

By contrast, if the brush fiber 31 is inclined, as shown in FIG. 7, the conductive material 32 provided inside the brush fiber 31 hardly contact the toner particle T. Therefore, it is possible to prevent the charge from the cleaning brush 23 to the toner during movement of the toner from the photoconductor 1 to the cleaning brush 23 and from the cleaning brush 23 to the toner collection roller 24.

The brush fiber 31 may be formed of any material having the double-layered core sheath structure in which the inner side thereof is formed of the conductive material 32 and the surface portion thereof is formed of the insulating material 33. Typical fibers with the "core sheath structure" in which the surface is an insulator and the inner side is a conductive material are disclosed in Japanese Patent Application Laid-open Nos. H10-310974, H10-131035, H01-292116, and Japanese Patent Application Kokai Nos. H07-033637, H07-033606, H03-064604, or the like.

The material of the brush fiber 31 is generally insulating materials such as nylon, polyester, and acryl, and all the materials have the same effect.

The structure of the toner collection roller 24 of the printer 100 according to this exemplary embodiment shown in FIG. 1 is different from that of the printer 1000 shown in FIG. 2, which is described in Japanese Patent Application No. 2006-275702. A metal roller made of SUS is used as the toner collection roller 24 of the printer 1000. By contrast, the toner collection roller 24 of the printer 100 of FIG. 1 is structured so as to wind a polyvinylidene fluoride (PVDF) tube around the metal core bar 23*a* and to further provide an insulating layer on its surface layer so as to reduce charge injection to the toner between the cleaning brush 23 and the toner collection roller 24.

As explained above, if the toner collection roller 24 is a roller whose surface has a resistive layer, a potential difference between the cleaning brush 23 and the toner collection roller 24 is more easily increased. If the metal roller is used, the tip potential of brush fibers 31 of the cleaning brush 23 is close to an applied voltage to the toner collection roller 24.

However, in this system also, if the low resistance surface layer is used as the toner collection roller 24, it is found that by increasing the voltage applied to the shaft of the toner collection roller 24 so as to increase toner collection performance from the cleaning brush 23, the polarity of the toner adhering to the cleaning brush 23 is reversed and the toner with the reversed polarity re-adhere to the photoconductor 1, and this causes the cleaning performance to be degraded.

For the problem, it is also found that, by increasing the resistance of the surface layer of the toner collection roller 24, re-adhesion of the toner to the photoconductor 1 is reduced. When a voltage is discretely supplied to the core bar 23*a* of the cleaning brush 23 and to the shaft of the toner collection roller 24, a high resistive layer is used as the surface layer of the toner collection roller 24 so that a surface resistivity is $1\times10^{10}$ Ω/cm$^2$ or more or a roller resistance is $1\times10^{10}$ Ω/cm$^2$ or more in a measurement method A shown below. By using the toner collection roller 24 as explained above, it is resulted that the polarity of the toner held between the brush fibers 31 and the toner collection roller 24 is difficult to be reversed as compared with the case of using a roller with a metal surface.

More specifically, the residual toner having passed through the transfer process and before being cleaned passes through the contact portion between the polarity control blade 22 and the photoconductor 1, and is controlled to have the negative polarity. Moreover, a positive polarity voltage V1 is applied to the core bar 23*a* of the cleaning brush 23. Specifically, the positive polarity voltage V1 is set so that the tip potential of the cleaning brush 23 is higher than the surface potential of the photoconductor 1 in the downstream side of the contact portion between the polarity control blade 22 and the photoconductor 1 in the movement direction of the surface of the photoconductor 1. A positive polarity V2 is applied also to the shaft of the toner collection roller 24 (V2>V1). Based on the configuration, the toner controlled to the negative polarity by the polarity control blade 22 is collected by adhering to the cleaning brush 23 with a slightly positive polarity and then adhering to the high voltage toner collection roller with a more positive polarity than that of the cleaning brush 23. At this time, if the surface of the toner collection roller 24 is metal or a low resistive layer, it is resulted that the polarity of the toner held between the brush fibers 31 and the toner collection roller 24 is easily reversed.

When the polarity of the toner adhering to the cleaning brush 23 is reversed, the toner has the positive polarity and adheres to the cleaning brush 23 with a lower voltage than that of the toner collection roller 24 even with the same positive polarity. Consequently, the positive polarity toner exists in the cleaning brush 23, and because the surface potential of the photoconductor 1 is in the negative polarity side than the tip potential of the cleaning brush 23, the toner adheres to the photoconductor 1 from the cleaning brush 23, which causes a cleaning failure, and the toner is output from the cleaning unit 20. This causes failure such as contamination of a charger.

By contrast, when the surface of the toner collection roller 24 has a high resistive layer, the polarity of the toner held between the brush fibers 31 and the toner collection roller 24 is difficult to be reversed, and as a result, a cleaning failure due to the toner with the reversed polarity is difficult to occur.

The measurement method A is explained below.

Resistance of the toner collection roller 24 was measured by using a UA probe of Hiresta UP manufactured by a Dia Instruments Co., Ltd. in such a manner that a grounded metal electrode and the roller shaft were connected by a conductor wire, one of two electrodes of the probe was caused to contact the roller surface and the other electrode was caused to contact the grounded metal electrode, and an electrical resistance in "Q" was determined from a current when a given voltage was applied 10 seconds. The given voltage was 500 volts in an environment of 32° C. and 80%, and was 1,000 volts in an environment of 10° C. and 15%.

As explained above, it is found that his configuration has an advantage that when the surface of the toner collection roller 24 has the high resistive layer ($1\times10^{10}$ Ω·cm or greater) or has the insulating layer, the polarity of the toner held between the brush fibers 31 and the toner collection roller 24 is difficult to be reversed, however, the following failure may occur.

Specifically, a surface potential V4 of the toner collection roller 24 is measured after the toner having adhered to the surface of the toner collection roller 24 is cleaned by the toner collection roller cleaning blade 27, and it is thus found that the surface potential V4 decreases with increasing amount of toner adhesion per unit area. It is also found that a tip potential V3 of the cleaning brush 23 rotating while contacting the toner collection roller 24 also decreases.

When the surface potential V4 of the toner collection roller 24 decreases, the performance of the toner collection roller 24 that removes the toner from the cleaning brush 23 decreases, and the toner adhering to the cleaning brush 23 is not collected by the toner collection roller 24, so that the toner may pass through the contact portion between the cleaning brush 23 and the toner collection roller 24. If the toner adhering to the cleaning brush 23 passes through the contact portion therebetween, the toner reaches the contact portion between the cleaning brush 23 and the photoconductor 1, and re-adheres to the photoconductor 1, which may cause a cleaning failure.

As explained above, if the tip potential V3 of the cleaning brush 23 decreases, the performance of the cleaning brush 23 that removes the toner from the photoconductor 1 decreases, and the toner cannot perfectly be removed from the surface of the photoconductor 1, which may cause a cleaning failure.

The reason of decrease in the tip potential V3 of the cleaning brush 23 is not apparent, however, the following are thought as factors.

When the toner with the charge adhering to the surface of the brush fibers 31 moves to the toner collection roller 24, separating discharge may occur to apply the voltage with the negative polarity to the brush fibers 31, the surface being an insulating layer. Alternatively, even after the voltage with the negative polarity is applied from the toner due to toner adhesion to the surface of the brush fibers 31 and further to the toner collection roller 24, the voltage applied to the surface of the brush fibers 31 may remain thereon. Therefore, the cleaning unit 20 according to this exemplary embodiment includes a cleaning brush charge imparting member 39, which will be described in detail later.

Further, the same problem can occur to the toner collection roller 24 but the reason of decrease in the surface potential V4 of the toner collection roller 24 is not apparent as well as the tip potential V3 of the cleaning brush 23. However, the following are thought as factors. That is, when the charged toner that adheres to the surface of the toner collection roller 24 is scraped by the toner collection roller cleaning blade 27, the surface potential V4 of the toner collection roller 24 may decrease. When the charged toner adhering the surface of the toner collection roller 24 is scraped by the toner collection roller cleaning blade 27, the separation discharge may occur, which can result in application of the voltage with the negative polarity to a high resistance layer or an insulating layer. This application of the voltage with the negative polarity can decrease the surface potential V4 of the toner collection roller 24. Alternatively, even after the voltage with the negative polarity is applied from the toner due to toner adhesion to the surface of the brush fibers 31 and the toner is scraped off by the toner collection roller cleaning blade 27, the voltage applied to the surface of the brush fibers 31 may remain thereon, which can decrease the surface potential V4 of the toner collection roller 24. Therefore, the cleaning unit 20 according to this exemplary embodiment includes a roller cleaning blade power source 42 so as to apply a voltage to the toner collection roller cleaning blade 27 that contacts the toner collection roller 24. The voltage is higher than a voltage applied to a shaft of the toner collection roller 24.

Next, a description is given of a cleaning brush charge imparting member 39 that serves as a brush fiber charge imparting member to impart a charge to the cleaning brush 23 in which a tip potential thereof is decreased.

As explained above, when the toner moves from the cleaning brush 23 to the toner collection roller 24, the tip potential of the brush decreases. Further, when the surface potential of the brush fibers 31 of the cleaning brush 23 decreases, the toner removability from the photoconductor 1 may degrade.

Therefore, the cleaning unit 20 according to this exemplary embodiment includes the cleaning brush charge imparting member 39 of metal (made of SUS) arranged so as to contact the brush fibers 31 or surface of the cleaning brush 23 after the cleaning brush 23 contacts the toner collection roller 24 as shown in FIG. 1. The cleaning unit 20 also includes a brush charge imparting power source 34 that serves as a brush charge imparting voltage applying unit to apply a voltage to the cleaning brush charge imparting member 39, so that the brush charge imparting power source 34 can apply a voltage substantially same as the core bar 23*a* of the cleaning brush 23 to the cleaning brush charge imparting member 39. In this exemplary embodiment, a voltage of 600V is applied from the brush power source 30 to the core bar 23*a* of the cleaning brush 23, and a voltage of 600V is applied from the brush charge imparting power source 34 to the charging member 39. Thus, the surface of the brush fibers 31 in which the potential thereof is lowered can be recharged.

The charging unit 20 according to this exemplary embodiment includes the cleaning brush charge imparting member 39, and this allows prevention of decrease in the tip potential of the brush that occurs upon removal of the toner from the cleaning brush 23, so that the tip potential of the cleaning brush 23 is maintained. As a result, the tip potential of the cleaning brush 23 that directly contacts and rubs the photoconductor 1 therewith can be maintained to a potential at which the toner on the photoconductor 1 can be satisfactorily cleaned. With this feature, the cleaning can be stably performed over time.

A power source that applies a voltage to the cleaning brush charge imparting member 39 is not limited to a configuration in which the power source is provided independently from the brush power source 30. Thus, it may be a configuration to apply a voltage of the same magnitude as that of the voltage applied to the core bar 23*a* thereto from the brush power source 30.

As described above, in the cleaning unit 20 of FIG. 1, even if the movement of toner from the cleaning brush 23 to the toner collection roller 24 decreases the tip potential of the brush fibers 31, the charge imparting member 39 can recover the tip potential of the brush fibers to a potential of the charge imparting member 39. This action can prevent poor cleaning performance due to a decrease in the tip potential of the brush fibers 31.

Next, a description is given of a relation of adhesion of the conductive tape 38 to the polarity control blade 22 and polarity control performance.

The toner is charged to the same polarity as the voltage that is applied to the polarity control blade 22 by applying the voltage to the polarity control blade 22 to flow current from the polarity control blade 22 to the toner or by inverting the toner polarity by the electrical discharge at the small gap formed between the polarity control blade 22 and the photoconductor 1.

Thus, as the volume resistance of the polarity control blade 22 is reduced, the lower voltage can be applied to the blade power source 29 to invert the toner polarity. Metal is most preferable material to make the voltage to be applied to the blade power source 29 as lower as possible. However, when a metallic material is used and the photoconductor 1 has a pinhole thereon, a current may be supplied from the polarity control blade 22 to an aluminum base body of the photoconductor 1 via the pinhole. If the current moves from the polarity control blade 22 to the base body of the photoconductor 1, the polarity control blade 22 cannot be charged, which prevents controlling the toner polarity. Therefore, the polarity control blade 22 may need to have a certain volume resistance. When a conductive urethane rubber is used as the polarity control blade 22, the volume resistance of the polarity control blade 22 is limited to be $10^5$ Ω·cm at lowest.

Further, in the printer 1000 that includes the polarity control blade 22 of the cleaning unit 200 of FIG. 2, the voltage is generally applied to the polarity control blade 22 from the blade power source 29 attached to the main body of the printer 1000 via the blade holder 21 that serves as a blade supporting member for fixing the polarity control blade 22 to the main body of the printer 1000. Thus, the printer 1000 employs a blade supporting member that is conductive and highly rigid and made of material such as metal.

Figure 9:
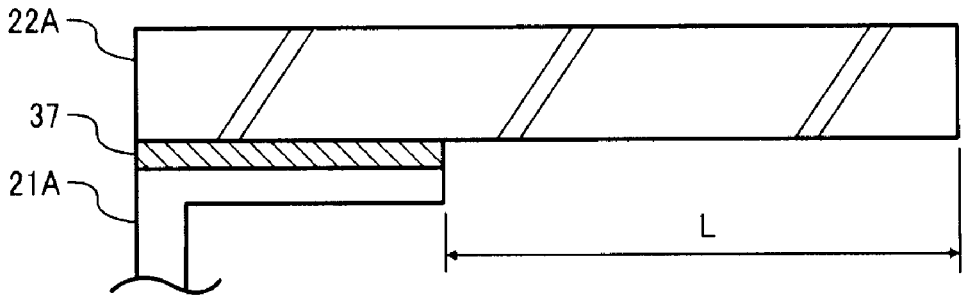
FIG. 9 is an enlarged view for explaining an example polarity control blade and blade holder.

FIG. 9 is an enlarged view for explaining an example polarity control blade 22A and blade holder 21A. As shown in FIG. 9, the polarity control blade 22A is fixed to the blade holder 21A with conductive adhesive 37, which serves as an electrode, so as to create electrical conduction between the polarity control blade 22A and the blade holder 21A by the conductive adhesive 37. That is, the polarity control blade 22A cannot cause a fixed part that is fixedly attached to the blade holder 21A to be elastically deformable and, by contrast, can cause a free length part L from a leading end part of the blade holder 21A to a tip of the polarity control blade 22A which contacts the surface of the photoconductor 1 to be elastically deformable.

Further, the toner polarity control requires that a relation of a distance between a contact part of the polarity control blade 22A and a leading end part of an electrode or the conductive adhesive 37 and a distance or free length of the polarity control blade 22A are constantly equal. When these distances are different, the polarity control performance for the longer distance may become poorer. In other words, a surface resistance from the leading end part of the electrode for the polarity control blade 22A to the contact part of the polarity control blade 22A and the photoconductor 1 may become a problem.

The polarity control blade 22A is disposed in contact with the surface of the photoconductor 1 in a counter manner so as to scrape off the residual toner remaining on the surface of the photoconductor 1 to reduce an amount of toner to be conveyed to the cleaning brush 23.

When the conductive adhesive 37 is used to create the electrical conduction between the polarity control blade 22A and the blade holder 21A, which is a conventional method, both the length of elastically deformable part of the polarity control blade 22A, or an overhang length of the polarity control blade 22A, and the length between the electrode that applies a voltage to the polarity control blade 22A and the contact part of the polarity control blade 22A and the photoconductor 1 correspond to the free length L. Therefore, to reduce the distance from the leading end part of the electrode and the contact part of the polarity control blade 22A and the photoconductor 1, the free length L shown in FIG. 9 may need to be decreased to reduce the overhang length of the polarity control blade 22A.

A preferable overhang length of the polarity control blade 22 that is used in the printer 100 of FIG. 1 is approximately 7 mm. When the overhang length is greater than 7 mm, the polarity control blade 22 may easily curl inwardly with the rotation of the photoconductor 1. By contrast, when the overhang length is less than 7 mm, a linear pressure of the polarity control blade 22 increases while an overcut of the polarity control blade 22 against the surface of the photoconductor 1 is equal with different overhang lengths. When the linear pressure of the polarity control blade 22 is reduced with the overhang length thereof being less than 7 mm, higher positional accuracy between the polarity control blade 22 and the photoconductor 1 may be required, which can result in an increase in cost. Further, when the linear pressure of the polarity control blade 22 increases, respective wear volumes of the photoconductor 1 and the polarity control blade 22 may increase with time. Consequently, the increase in wear volume of the polarity control blade 22 can cause degradation of performance of the polarity control.

Following the above-described situation, the cleaning unit 20 of the printer 100 of FIG. 1 connects the blade holder 21 and the polarity control blade 22 electrically by the conductive tape 38 that serves as a conductive member.

Figure 10:
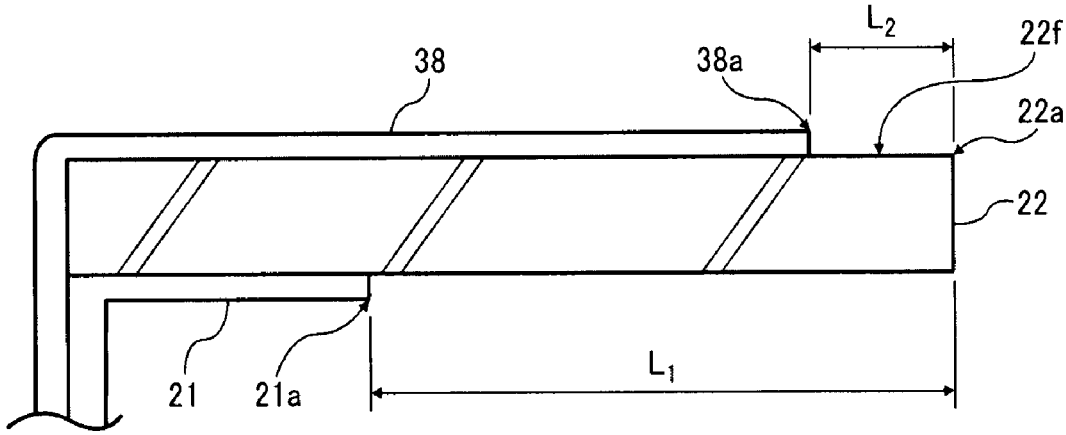
FIG. 10 is an enlarged cross-sectional view for explaining a polarity control blade and a blade holder of a cleaning unit according to an exemplary embodiment.

FIG. 10 is an enlarged cross-sectional view of the blade holder 21 and the polarity control blade 22 of the cleaning unit 20 according to this exemplary embodiment. The polarity control blade 22 shown in FIG. 10 includes an edge part 22*a* that is a contact part or a part contacting the surface of the photoconductor 1. As shown in FIG. 10, the conductive tape 38 is attached over the blade holder 21 and the polarity control blade 22 in the cleaning unit 20 so that the blade holder 21 and the polarity control blade 22 can be connected electrically by the conductive tape 38 to create a conduction state.

Further, the conductive tape 38 includes an edge part 38*a* that is an end part of the conductive tape 38 that is attached to the side where the edge part 22*a* of the polarity control blade 22 is disposed. The conductive tape 38 is attached so that the edge part 38*a* thereof can be closer to where the edge part 22*a* of the polarity control blade 22 contacts the surface of the photoconductor 1 than an edge part 21*a* of the blade holder 21. That is, a relation of "L1>L2" is satisfied, where "L1" represents an overhang length that corresponds to the free length of the polarity control blade 22 and "L2" represents an electrode distance that corresponds to a distance from the edge part 38*a* of the conductive tape 38 serving as an electrode to supply a voltage to the polarity control blade 22 to the edge part 22*a* of the polarity control blade 22. Specifically, the electrode distance L2 from the edge part 38*a* to where the edge part 22*a* contacts the surface of the photoconductor 1 is shorter than the overhang length L1 from the edge part 21*a* to where the edge part 22*a* contacts the surface of the photoconductor. When compared with the polarity control blade 22A of FIG. 9, the above-described structure can reduce the distance between the contact part of polarity control blade 22 to the photoconductor 1 and the edge part 38*a* of the conductive tape 38 serving as an electrode, without reducing the overhang length of the polarity control blade 22. Therefore, the cleaning performance of the polarity control blade 22 can be maintained and a desired polarity control of residual toner can be conducted with a lower voltage applied by the blade power source 29.

In the cleaning unit 20 of FIG. 1 according to this exemplary embodiment, the polarity control blade 22 further includes an opposed surface 22*f* that faces the photoconductor 1 to attach the conductive tape 38 thereto. Alternatively, the conductive tape 38 can be attached to an opposite side or back side of the opposed surface 22*f* of the polarity control blade 22.

Figure 11:
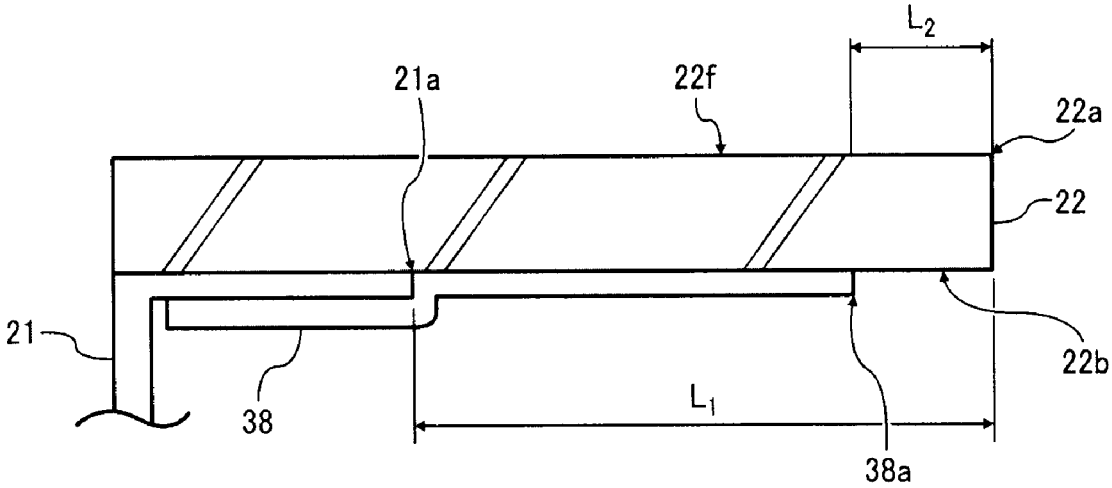
FIG. 11 is an enlarged cross-sectional view for explaining a modified structure of the polarity control blade and the blade holder according to a modified exemplary embodiment.

FIG. 11 is an enlarged cross-sectional view of a modified structure of the polarity control blade 22 with the conductive tape 38 attached, according to a modified exemplary embodiment. In FIG. 11, the conductive tape 38 is attached to a back side 22*b* of the polarity control blade 22, where the back side 22*b* thereof corresponds to a back side of the opposed surface 22*f*.

In the modified exemplary embodiment shown in FIG. 11, the conductive tape 38 is attached to the polarity control blade 22 and the blade holder 21 while satisfying the relation of "overhang length L1>electrode distance L2." By so doing, the cleaning performance of the polarity control blade 22 can be maintained and a voltage applied by the blade power source 29 can be reduced.

However, even though the electrode distance L2 shown in FIG. 10 and the electrode distance L2 shown in FIG. 11 are set to be equal, the thickness of the polarity control blade 22 may need to be considered. That is, when compared to the polarity control blade 22 with the conductive tape 38 attached to the opposed surface 22*f*, a distance that affects to the surface resistance from the edge part 38*a* of the electrode or the conductive tape 38 to the edge part 22*a* may become longer when the conductive tape 38 is attached to the back side 22*b* of the polarity control blade 22. Specifically, a thickness of the polarity control blade 22 ranges from approximately 1.5 mm to approximately 2.8 mm. It is preferable that the conductive tape 38 is attached to the opposed surface 22*f* so that the distance that affects to the surface resistance can be reduced and therefore the voltage applied by the blade power source 29 can be set to a lower value.

Figure 12:
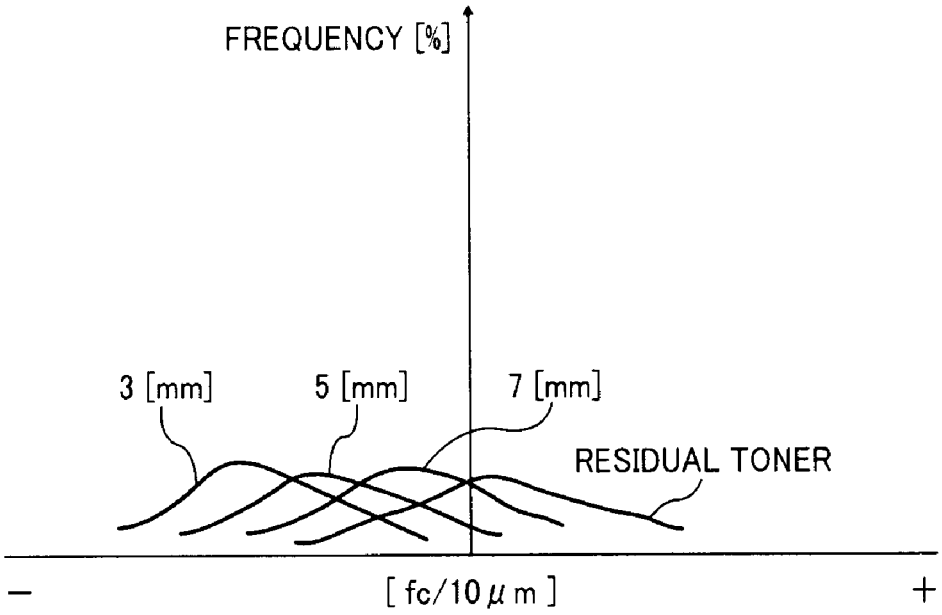
FIG. 12 is a graph representing a relation of an electrode distance and a polarity control performance.

FIG. 12 is a graph representing a relation of the electrode distance L2 from the edge part 38*a* of the conductive tape 38 to the edge part 22*a* of the polarity control blade 22. The graph of FIG. 12 shows results of changes of the electrode distance L2, which were obtained by applying a voltage fixed to −200V to the polarity control blade 22 by the blade power source 29 and changing a position of the edge part 38*a* of the conductive tape 38 only.

A waveform indicated by "7 mm" of the electrode distance L2 in FIG. 12 is substantially equal to the overhang length of 7 mm of the polarity control blade 22 from the blade holder 21 in the cleaning unit 20 as shown in FIG. 2 and the applied voltage is −200V as shown in FIG. 6.

As shown in FIG. 12, as the electronic distance L2 becomes shorter, the toner q/d distribution of residual toner after the polarity control conducted by the polarity control blade 22 may shift to the left-hand side or the side of normal charge polarity of the toner in the graph of FIG. 12. That is, even if the applied voltage values are identical to each other, when the electrode distance L2 is changed or reduced, a desired toner q/d distribution can be obtained.

Further, even though the graph of FIG. 12 shows the results of the toner q/d distributions with the electrode distance L2 from 3 mm and greater. However, the electrode distance L2 less than 3 mm can also be applied to the graph of FIG. 12.

Further, it is contemplated that the toner q/d distribution after the toner polarity control is advantageous in a certain range along the horizontal axis of the graph of FIG. 12. Broadly, there are differences in applied voltages between the photoconductor 1 and the cleaning brush 23 and between the cleaning brush 23 and the toner collection roller 24 in an electrostatic cleaning part after conducting the toner polarity control because at least a charge injection to toner occurs in principle.

Therefore, the toner q/d distribution after the polarity control is preferably provided in a range slightly separated from "0 fc/10 μm", and more preferably in a range equal to or greater than "−2 fc/10 μm", which corresponds to a value of "−2 fc/10 μm" and smaller to the left-hand side in the graph of FIG. 12. The above-described range is a range in which the polarity of toner may not be inverted to maintain the state in one polarity even when the charge injection occurs to a small amount of toner.

Further, the charge amount of toner increases where the negative polarity is greater (to the further left-hand side). When the charge amount of toner is too large, an adhesion force of toner to the photoconductor 1 may increase, which can cause an electrostatic force of the cleaning brush 23 to make it difficult to clean the photoconductor 1. Therefore, the toner q/d distribution after the polarity control is preferably provided in a range slightly separated from "0 fc/10 μm", and more preferably in a range equal to or smaller than "−8 fc/10 μm". That is, when the toner q/d distribution after conducting the polarity control is controlled in a range of from "−2 fc/10 μm" to "−8 fc/10 μm", the cleaning performance can be more preferable.

Figure 13A:
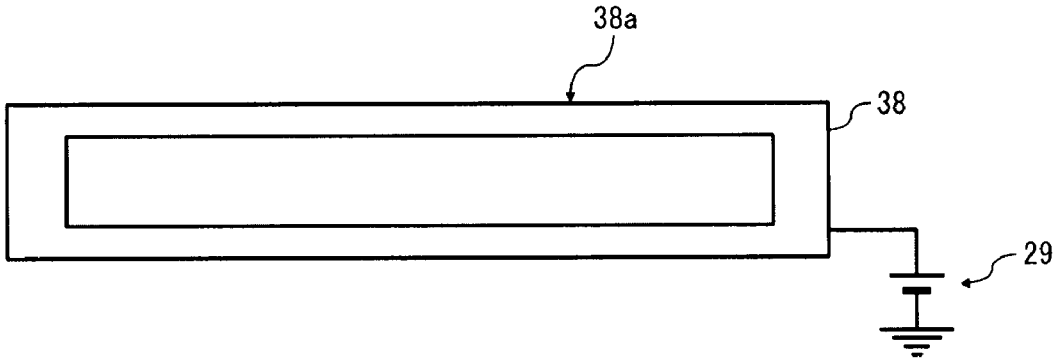
FIGS. 13A, 13B, and 13C are views illustrating examples of attachment of a conductive tape.
Figure 13B:
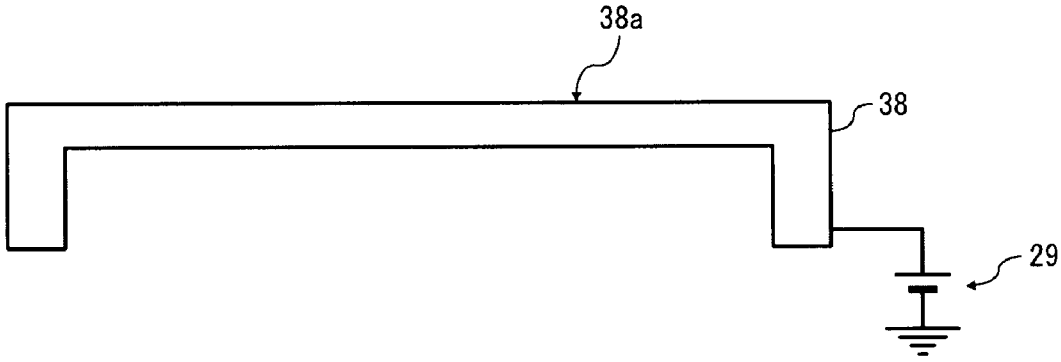
Figure 13C:
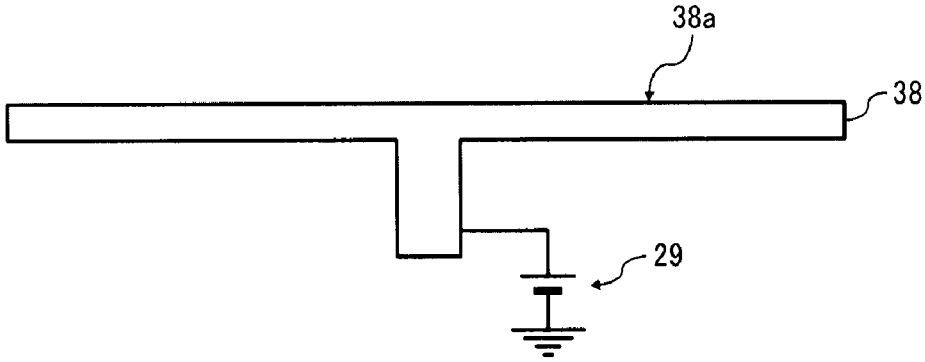

FIGS. 13A to 13C are top views illustrating examples of attachment of conductive tape 38.

The conductive tape 38 can be attached to the surface of the polarity control blade 22 in a range of a whole area from an edge part opposite to the edge part 22*a* of the polarity control blade 22 to the edge part 38*a* of the conductive tape 38. However, if the conductive tape 38 is attached to the above-described area on the surface of the polarity control blade 22, the polarity control blade 22 is reinforced by the conductive tape 38 and it is not likely that the polarity control blade 22 can be flexibly deformed. Therefore, it is preferable that the conductive tape 38 is attached to the surface of the polarity control blade 22 over an area as shown in FIGS. 13A to 13C.

As a specific example of the conductive tape 38 to be employed for this exemplary embodiment, the conductive cloth adhesive tape No. 1821 as a shielding adhesive tape manufactured by Teraoka Seisakusho Co., Ltd. was used.

In a case where the conduction state is created between the blade holder 21 and the polarity control blade 22, not only the above-described conductive cloth adhesive tape but also other conductive tapes can be applied to the present invention.

In the configuration in which the conductive adhesive 37 electrically connects the polarity control blade 22 and the blade holder 21 to create a conduction state, when the applied voltage is fixedly set to −200V and a length of a free length part L is changed, a relation between the length of the free length part L and the performance in polarity control may be similar to a case when the electrode distance L2 is changed, as shown in FIG. 12.

Consequently, even in the conventional configuration using the conductive adhesive 37 to electrically connect the polarity control blade 22 and the blade holder 21 to create a conduction state, as the length of the free length part L is shorter, the toner q/d distribution after the polarity control shifts much further to the left-hand side in the graph of FIG. 12. However, if the length of the free length part L is reduced in the above-described configuration using the conductive adhesive 37, the cleaning performance of the polarity control blade 22 may degrade or become poorer, which can cause a problem. Thus, it is difficult to reduce the length of the free length part L in the above-described configuration.

By contrast, as shown in FIG. 10, when the electrode distance L2 is reduced by attaching the conductive tape 38 on the surface of the polarity control blade 22, mechanical toner scraping performance of the polarity control blade 22 can be maintained and the polarity control of toner can be conducted with a lower voltage.

Next, parameters of a specific configuration of an electrostatic cleaning part of the cleaning unit 20 are described:

- Material of cleaning brush: conductive polyester, thickness of brush: 5 mm;
- Cutover of cleaning brush to photoconductor drum: 1 mm;
- Linear velocity of cleaning brush: 200 mm/s (same as the photoconductor drum);
- Applied voltage to cleaning brush charge imparting member: 600V;
- Applied voltage to cleaning brush shaft: 600V;
- Brush original yarn resistance: 108 Ωcm, brush fiber density: 100,000/inch$^2$;
- Brush shape: inclined to a downstream side in a direction of rotation of brush;
- Material of toner collection roller: PVDF tube surface layer (100 μm) and UV coat layer (5 μm) on a SUS core bar, insulated;
- Diameter of toner collection roller: ϕ10 mm;
- Linear velocity of toner collection roller: 200 mm/s;
- Voltage applied to toner collection roller shaft: 900V;
- Electrical resistance of toner collection roller cleaning blade: $10^6$ Ω·cm to $10^8$ Ω·cm;
- Contact angle of toner collection roller cleaning blade: 20 degrees;
- Cutover of toner collection roller cleaning blade to toner collection roller: 1 mm;
- Thickness of toner collection roller cleaning blade: t=2 mm;
- Free length of toner collection roller cleaning blade: 7 mm;
- Hardness of toner collection roller cleaning blade: 60-80 with JIS-A hardness scale;
- Rebound resilience of toner collection roller cleaning blade: 30%;
- Voltage applied to toner collection roller cleaning blade: 1200V.

In the apparatus used in the explanation, a volume resistivity of the toner collection roller cleaning blade 27 is $1\times10^8\Omega$, however, an effect due to imparting of the charge increases by selecting a low resistance blade material in a range of causing the cleaning performance of the toner on the toner collection roller 24 not to be decreased. It is desirable to select a blade material so that a resistance of the toner collection roller cleaning blade 27 does not increase particularly at low temperature and low humidity although there is not much problem with high temperature and high humidity.

As shown in FIG. 7, it is contemplated that, even if each of the brush fibers 31 of the cleaning brush 23 has the core sheath structure and is inclined in the rotational direction, the surface potential of the fiber decreases and the tip potential of the brush thereby decreases because the toner on the photoconductor 1 is moved by means of an electric field between the internally provided conductive material 32 of each of the brush fibers 31 and the photoconductor 1 through the insulating material 33 of the surface portion of the brush fiber 31, and by means of an electric field between the conductive material 32 and the surface potential of the toner collection roller 24.

Specifically, in the cleaning brush 23 of which each fiber whose surface portion is formed of uniformly dispersed conductive material is straight or inclined, the surface potential of the fiber does not decrease. Therefore, the decrease in the surface potential of the fiber occurs only in a combination of an inclined brush made of fibers with the core sheath structure with the high resistance or insulated collecting roller, as is the cleaning unit 20 according to the exemplary embodiment.

Further, a voltage with opposite polarity to the above-described configuration may be applied to the polarity control blade 22, the cleaning brush 23, the toner collection roller 24, and the toner collection roller cleaning blade 27 of the cleaning unit 20. More specifically, a voltage with the positive polarity is applied to the polarity control blade 22, and a voltage with the negative polarity is applied to the cleaning brush 23, the toner collection roller 24, and the toner collection roller cleaning blade 27. In this case, the voltage with the negative polarity that is the opposite polarity to that of the configuration is also applied to the cleaning brush charge imparting member 39. By applying the positive polarity voltage to the polarity control blade 22, charged polarities of the residual toner particles passing through the contact portion between the surface of the photoconductor 1 and the polarity control blade 22 are made uniform to the positive polarity. The toner particles with the uniform positive polarity are removed from the surface of the photoconductor 1 by the cleaning brush 23, the toner collection roller 24, and the toner collection roller cleaning blade 27 which are applied with the negative polarity voltage.

The printer 100 according to this exemplary embodiment uses spherical toner with a shape factor SF-1 of 100 to 150.

When the spherical toner is used, the toner is less removed from the photoconductor 1 using the polarity control blade 22 than that when pulverized toner is used. However, even if multiple toner particles pass through the cleaning brush 23, the polarity control blade 22 makes the charged polarities of the toner particles uniform to one polarity, and the cleaning brush 23 removes the toner particles from the photoconductor 1. Thus, even if the spherical toner is used, the cleaning performance can be maintained.

Removal of toner on the toner collection roller 24 will be described below.

When the toner collection roller cleaning blade 27 is used to mechanically scrape off the toner on the toner collection roller 24, the spherical toner is difficult to be removed.

How the removal of the spherical toner on the toner collection roller 24 is possible will be explained below.

The toner collection roller 24 only has a function of transferring the toner adhering to the cleaning brush 23 to the toner collection roller 24 by means of a potential gradient between the cleaning brush 23 and the toner collection roller 24, and any material can be used, differently from the photoconductor 1. To maintain the potential gradient with the cleaning brush 23, a roller with a resistance of $1\times10^{10}$ Ω or more in the previously measurement method A is preferably used as the toner collection roller 24.

Excellent cleaning performance of the toner collection roller 24 is also required, and thus, the surface thereof may be coated with a material having a low frictional factor, or a conductive tube having a low frictional factor may be wound around a metal roller. Specifically, the toner collection roller 24 may be treated with fluorine coating or may be wounded by PVDF or PFA tube. Thus, even spherical toner particles can be easily removed. Further, the surface of the toner collection roller 24 may be insured. Example materials for insulating the surface of the toner collection roller 24 include a PVDF tube, a PI tube, acrylic coat, silicone coat (e.g., coating PC containing silicone particles), and ceramics. In this case, respective values of applied voltages to the polarity control blade 22, the cleaning brush 23, and the toner collection roller 24 are simply set to be appropriate allowing for use environment or the like.

Further, since a voltage is applied to the toner collection roller cleaning blade 27, similar to the polarity control blade 22, the toner collection roller cleaning blade 27 also uses tape having conductivity such as conductive tape 38 to become conductive with a toner collection blade supporting member 26, so as to achieve a desired effect.

Figure 14:
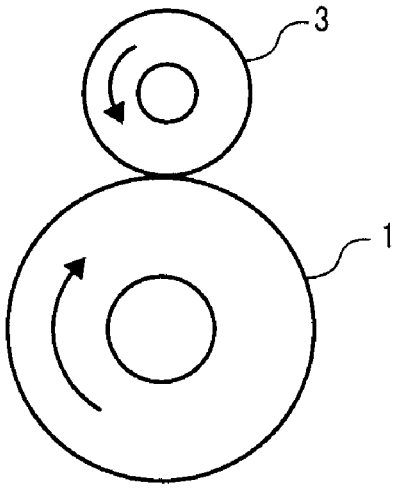
FIG. 14 is a schematic structure of a charging roller in contact with the photoconductor.
Figure 15:
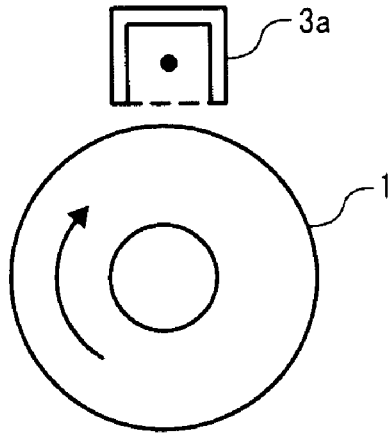
FIG. 15 is a schematic structure of a charging unit as a corona charger.
Figure 16:
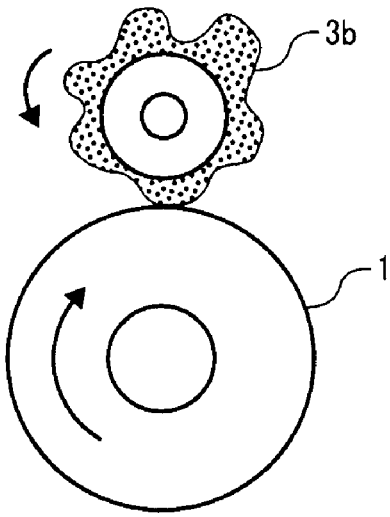
FIG. 16 is a schematic structure of the charging unit as a magnetic brush.
Figure 17:
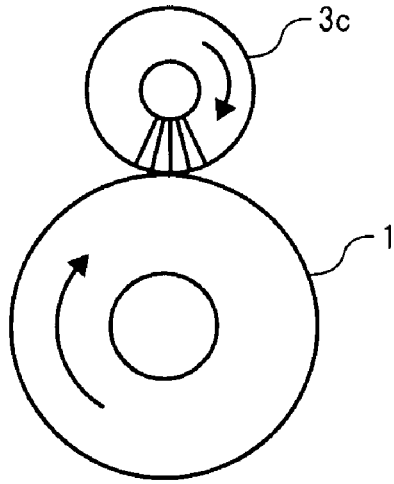
FIG. 17 is a schematic structure of the charging unit as a fur brush.

In the above-described exemplary embodiment, the charging roller 3 that serves as a charging unit that charges the surface of the photoconductor 1 is arranged in a non-contact manner with a given distance to the surface of the photoconductor 1. However, the charging roller 3 may be in contact with the photoconductor 1 as shown in FIG. 14. The surface of the photoconductor 1 may be charged not only by the charging roller 3 but also by a corona charger 3*a* as shown in FIG. 15. The charging unit may be a magnetic brush 3*b* as shown in FIG. 16, or may be a fur brush 3*c* as shown in FIG. 17.

An exemplary embodiment and operations of the photoconductor 1 employed in the image forming apparatus according to exemplary embodiments is described in detail below.

The photoconductor 1 used in exemplary embodiments may include an amorphous silicon photoconductor (hereinafter referred to as an "a-Si photoconductor"). A conductive support is heated to from 50° C. to 400° C., and a photoconductive layer including an amorphous silicon (hereinafter referred to as an "a-Si") is formed on the conductive support by using a film formation method such as a vacuum evaporation method, a sputtering method, an ion plating method, a thermal CVD method, an optical CVD method, and a plasma CVD method. Among the above-described examples, the plasma CVD method, in which a gas is decomposed by a direct-current, or a high-frequency glow discharge or a microwave glow discharge to form an a-Si sedimentary film on the conductive support, may be used.

FIGS. 18A to 18D are schematic views illustrating a layer structure of the a-Si photoconductor.

Figure 18A:
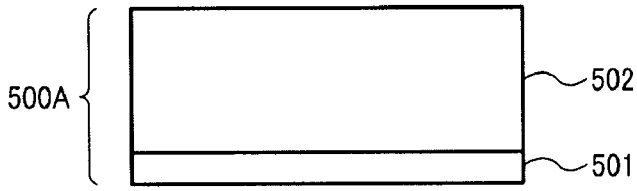
FIGS. 18A to 18D are illustrations for explaining layer structures of an amorphous-silicon photoconductor.

Referring to FIG. 18A, an a-Si photoconductor 500A includes a conductive support 501 and a photoconductive layer 502. The photoconductive layer 502 having a photoconductive property is formed on the conductive support 501, and includes an amorphous material including a silicon atom (Si), a hydrogen atom (H), and a halogen atom (X) (hereinafter referred to as an "a-Si:H,X").

Figure 18B:
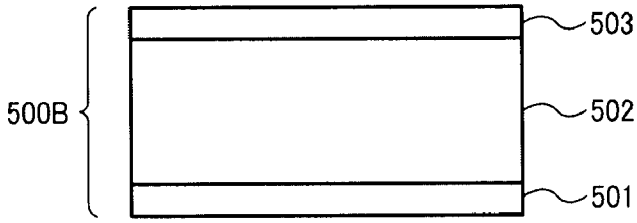

Referring to FIG. 18B, an a-Si photoconductor 500B includes the conductive support 501, the photoconductive layer 502 formed on the conductive support 501, and an a-Si surface layer 503 formed on the photoconductive layer 502.

Figure 18C:
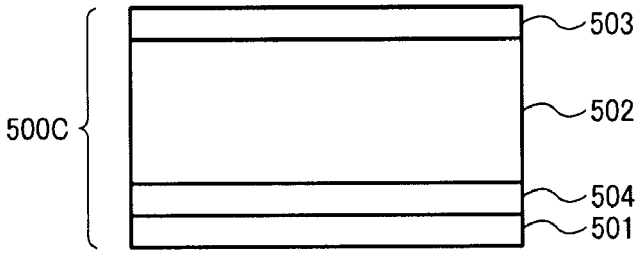

Referring to FIG. 18C, an a-Si photoconductor 500C includes the conductive support 501, the photoconductive layer 502 having a photoconductive property, the a-Si surface layer 503, and an a-Si charge injection block layer 504. The a-Si charge injection block layer 504 is sandwiched between the conductive support 501 and the photoconductive layer 502, and the a-Si surface layer 503 is formed on the photoconductive layer 502.

Figure 18D:
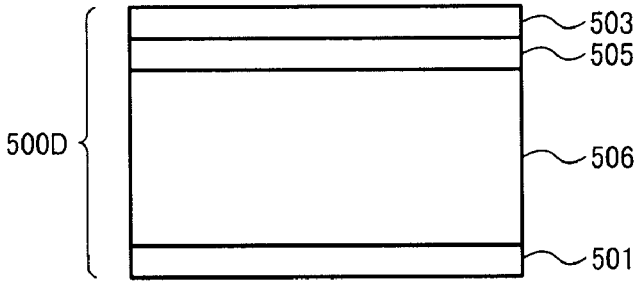

Referring to FIG. 18D, an a-Si photoconductor 500D includes, from bottom to top, the conductive support 501, a charge transport layer 506, a charge generating layer 505, and the a-Si surface layer 503. The charge transport layer 506 and the charge generating layer 505 include an a-Si:H,X, and a combination of the charge transport layer 506 and the charge generating layer 505 serves as the photoconductive layer 502.

Specific examples of the conductive materials used for the conductive support 501 include a metal such as Al, Cr, Mo, Au, In, Nb, Te, V, Ti, Pt, Pd, and Fe, and an alloy of the above-described metals such as a stainless steel. In addition, electric insulating supports such as a film or sheet of synthetic resins (e.g., polyester, polyethylene, polycarbonate, cellulose acetate, polypropylene, polyvinyl chloride, polystyrene, polyamide), a glass, a ceramic, and so forth, in which at least a surface thereof having a photoconductive layer is treated to have a conductive property, may be used as the conductive support 501.

The conductive support 501 may have a cylindrical shape, a plate shape, or a seamless-belt-like shape with a flat or uneven surface. A thickness of the conductive support 501 can be appropriately set based on a desired structure of the a-Si photoconductor 500A, 500B, 500C, or 500D. In a case in which flexibility is required for the a-Si photoconductor 500A, 500B, 500C, or 500D, the conductive support 501 may be formed as thin as possible, as long as the conductive support 501 reliably performs its function. However, the conductive support 501 may have a thickness of 10 μm or more, in consideration of manufacturing and handling processes and/or mechanical strength.

It may be more effective to form the a-Si charge injection block layer 504 between the conductive support 501 and the photoconductive layer 502 for preventing the charge injection from the conductive support 501 as shown in FIG. 18C. For example, the a-Si charge injection block layer 504 has a polarity dependence so as to reduce or prevent the charge injection from the conductive support 501 into the photoconductive layer 502 when the charge with a certain polarity is applied to a free surface of the a-Si surface layer 503. On the other hand, the a-Si charge injection block layer 504 does not prevent the charge injection when the charge with an opposite polarity is applied to the free surface of the surface layer 503. Therefore, the a-Si charge injection block layer 504 includes a relatively large number of atoms for controlling a conductive property thereof as compared with the photoconductive layer 502.

In order to achieve desired electrophotographic performance and economic performance, a thickness of the a-Si charge injection block layer 504 may be from 0.1 μm to 5 μm, from 0.3 μm to 4 μm, or from 0.5 μm to 3 μm.

The photoconductive layer 502 may be formed on an undercoat layer as needed, and a thickness of the photoconductive layer 502 may be appropriately set in consideration of achieving desired electrophotographic performance and economic performance. The thickness of the photoconductive layer 502 may be from 1 μm to 100 μm, from 20 μm to 50 μm, or from 23 μm to 45 μm.

The charge transport layer 506 mainly has a function of transporting a charge, which is a part of the function performed by the photoconductive layer 502. The charge transport layer 506 is formed by an a-SiC (H, F, and O) that includes at least a silicon atom, a carbon atom, and a fluorine atom, and may further include a hydrogen atom and an oxygen atom. According to exemplary embodiments, the charge transport layer 506 may include an oxygen atom. The charge transport layer 506 has a desired photoconductive property, and particularly has a charge retention property, a charge generation property, and/or a charge transport property.

A thickness of the charge transport layer 506 may be appropriately set in consideration of achieving desired electrophotographic performance and economic performance. The thickness of the charge transport layer 506 may be from 5 μm to 50 μm, from 10 μm to 40 μm, or from 20 μm to 30 μm.

The charge generating layer 505 mainly has a function of generating a charge, which is a part of the function performed by the photoconductive layer 502. The charge generating layer 505 includes a-Si:H that includes at least a silicon atom, but does not include a carbon atom, and may further include an amorphous material including a silicon atom, and a hydrogen atom, as needed. The charge generating layer 505 has a desired photoconductive property, and particularly has a charge generation property and a charge transport property.

A thickness of the charge generating layer 505 may be appropriately set in consideration of achieving desired electrophotographic performance and economic performance. The thickness of the charge generating layer 505 may be from 0.5 μm to 15 μm, from 1 μm to 10 μm, or from 1 μm to 5 μm.

The a-Si photoconductor 500A, 500B, 500C, or 500D may further include the a-Si surface layer 503 on the photoconductive layer 502 formed on the conductive support 501 as needed. The a-Si surface layer 503 includes a free surface, and may provide moisture resistance, tolerance for repeated use, electric pressure resistance, environmental capability, and/or durability.

A thickness of the a-Si surface layer 503 may be from 0.01 μm to 3 μm, from 0.05 μm to 2 μm, or from 0.1 μm to 1 μm. The a-Si surface layer 503 with a thickness less than 0.01 μm may be lost due to a friction or the like which occurs while the a-Si photoconductor 500 (500A, 500B, 500C, or 500D) is rotated. By contrast, the a-Si surface layer 503 with a thickness greater than 3 μm may cause a deterioration in electrophotographic performance due to an increase in a residual potential.

The a-Si photoconductor 500 (500A, 500B, 500C, or 500D) has high surface hardness, and provides high sensitivity for long wavelength light such as a semiconductor laser beam at from 770 nm to 800 nm. Furthermore, deterioration due to the repeated use is hardly observed. Thus, the a-Si photoconductor 500 (500A, 500B, 500C, or 500D) may be used as a photoconductor for forming electrophotographic images employed in a high-speed copying machine, a laser beam printer, and so forth.

The photoconductive layer is provided on the conductive base, and may contain a filler in the surface layer coated on the photoconductive layer or may use an organic photoconductive element based on a charge transport material as a cross-linking type charge transport material. By containing a particle material in the surface layer of the organic photoconductive element or by using the cross-lining type charge transport material, wear resistance of the surface layer can be increased.

The surface layer of the photoconductor 1 may include either a polymer or a copolymer of a compound including vinyl fluoride, vinylidene fluoride, chlorotrifluoroethylene, tetrafluoroethylene, hexafluoropropylene, or perfluoroalkyl vinyl ether.

The filler in the surface layer coated on the photoconductive layer may be either an organic filler or an inorganic filler, and the inorganic filler is preferably used.

Specific examples of organic fillers include fluorocarbon resin powder such as polytetrafluoroethylene, silicone resin powder, a-carbon powder, and so forth.

Specific examples of inorganic fillers include metal oxide powders such as silica, tin oxide, zinc oxide, titanium oxide, alumina, zirconium oxide, indium oxide, antimony oxide, bismuth oxide, calcium oxide, tin oxide doped with antimony, and indium oxide doped with tin; metallic fluoride such as tin fluoride, calcium fluoride, and aluminum fluoride; potassium titanate; and boron nitride. The examples of the filler described above may be used either alone or in combination. To improve dispersion, these fillers may be subjected to surface treatment using a surface treatment agent.

A conductive support may have a cylindrical or film shape formed of a metal such as aluminum and a stainless steel, paper, a plastic, and so forth. An undercoat layer having protection and adhesive performance may be provided on the conductive support. The undercoat layer is provided for improving adhesive and coating performance of the photoconductive layer, protecting the conductive support, covering a defect on the conductive support, improving the charge injection from the conductive support, and/or protecting the photoconductive layer from electric coating. Specific examples of a material included in the undercoat layer include polyvinyl alcohol, poly-N-vinyl imidazole, polyethylene oxide, ethyl cellulose, methyl cellulose, an ethylene-acrylic acid copolymer, casein, polyamide, a nylon copolymer, a glue, a gelatine, and so forth. Each of the above-described example materials is dissolved in a solvent suitable therefor, and is applied to the conductive support in a thickness of from 0.2 μm to 2 μm.

The photoconductive layer may have a laminated structure including the charge generating layer including a charge generating material, and the charge transport layer including a charge transport material, a single-layer structure including the charge generating material and the charge transport material, and so forth.

Specific examples of the charge generating material include a pyrylium dye, a thiopyrylium dye, a phthalocyanine pigment, an anthanthrone pigment, a dibenzopyrenequinone pigment, a pyranthrone pigment, a trisazo pigment, a disazo pigment, an azo pigment, an indigo pigment, a quinacridone pigment, unsymmetrical quinocyanine, quinocyanine, and so forth.

A cross-linked charge transport material may be used as the charge transport material. Specific examples of the charge transport material include a triarylmethane compound such as pyrene, N-ethylcarbazole, N-isopropyl carbazole, N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine, p-diethylaminobenzaldehyde-N,N-diphenylhydrazone, and p-diethylaminobenzaldehyde-(2-methylphenyl) phenylmethane, a polyarylalkane compound such as 1,1-bis (4-N,N-dimethylamino -2-methylphenyl)heptane and 1,1,2, 2-tetrakis(4-N,N-dimethylamino -2-methylphenyl)ethane, and a triarylamine compound.

The photoconductive element may be provided with a protective layer on the outermost surface thereof and added with a filler to improve wear resistance.

Specific examples of the organic filler include fluorocarbon resin powder such as polytetrafluoroethylene, silicone resin powder, a-carbon powder, and so forth. Specific examples of inorganic fillers include metal powders such as copper, tin, aluminum, and indium; metal oxide powders such as tin oxide, zinc oxide, titanium oxide, indium oxide, antimony oxide; and an inorganic material such as potassium titanate. The examples of the filler described above may be used either alone or in combination, and may be dispersed in a coating liquid for the protective layer with a suitable dispersing machine. An average particle diameter of the filler may be 0.5 μm or less, or 0.2 μm or less in consideration of penetration efficiency through the protective layer. According to exemplary embodiments, a plasticizer or a leveling agent may be added to the protective layer.

A toner particle that may be used in the image forming apparatus according to exemplary embodiments is described in detail below.

In exemplary embodiments, a toner particle having a high circularity with a shape factor SF-1 of from 100 to 150 is used. When a shape of the toner particle becomes close to a sphere, toner particles contact each other as well as the photoconductor 1 in a point contact manner. Consequently, absorbability between the toner particles decreases, resulting in an increase in fluidity. Moreover, absorbability between the toner particles and the photoconductor 1 decreases, resulting in an increase in a transfer rate. The use of a toner particle with a shape factor SF-1 of more than 150 is not preferable due to a decrease in the transfer rate.

Figure 19:
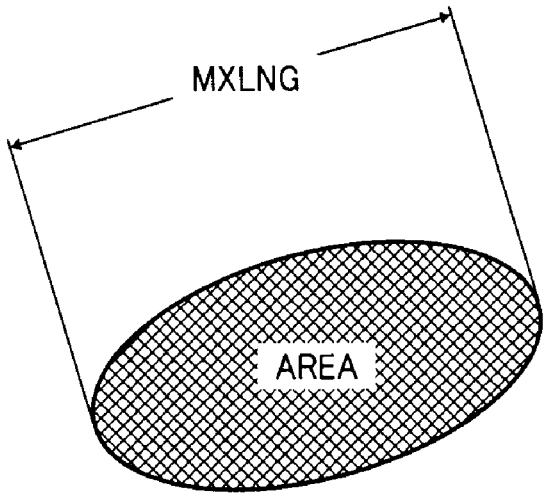
FIG. 19 is a schematic structure representing a shape of a toner particle for explaining shape factor SF-1.

FIG. 19 is a schematic view illustrating a shape of a toner particle for explaining the shape factor SF-1. The shape factor SF-1 indicates a proportional roundness of the toner particle, and is expressed by Equation 1 shown below:

$$SF\text{-}1=\{(MXLNG)^2/AREA\}\times(100\pi/4) \qquad \text{Equation 1.}$$

The shape factor SF-1 is obtained by dividing the square of the maximum length MXLNG of the shape produced by projecting the toner particle in a two-dimensional plane, by the figural surface area AREA, and subsequently multiplying by 100π/4.

Figure 20:
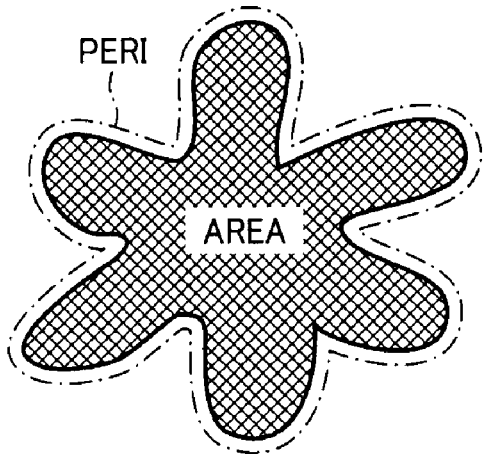
FIG. 20 is a schematic structure representing a shape of a toner particle for explaining shape factor SF-2.

FIG. 20 is a schematic view illustrating a shape of a toner particle for explaining a shape factor SF-2. The shape factor SF-2 indicates a proportional bumpiness of the toner shape, and is expressed by Equation 2 shown below:

$$SF\text{-}2=\{(PELI)^2/AREA\}\times(100/4\pi) \qquad \text{Equation 2.}$$

The shape factor SF-2 is obtained by dividing the square of the perimeter PER1 of the figure produced by projecting the toner particle in a two-dimensional plane, by the figural surface area AREA, and subsequently multiplying by 100/4π.

In specific terms, the shape factor SF-2 is measured by photographing randomly selected one hundred (100) toner particles with scanning electron microscope S-800 manufactured by Hitachi Ltd., putting photographic data of the toner particles in image analyzer Lusex 3 manufactured by Nireko Corporation via an interface to analyze the photographic data, and making calculations from analyzed data.

Figure 21:
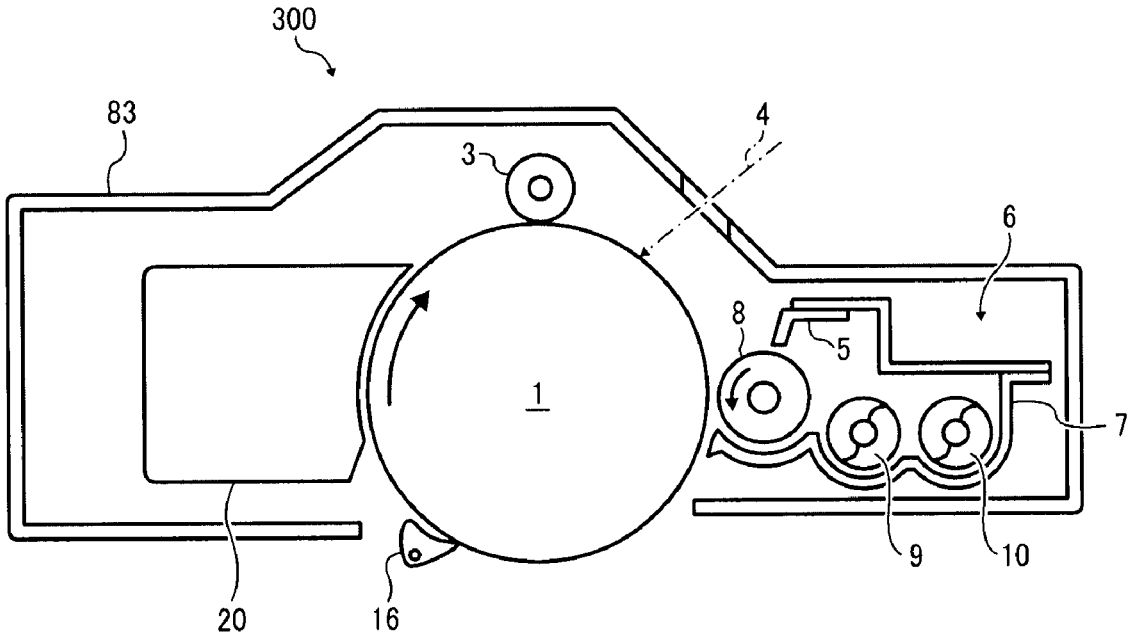
FIG. 21 is a schematic configuration of a process cartridge.

As shown in FIG. 21, the photoconductor 1 and the cleaning unit 20 may be integrally formed within a frame 83 to form a process cartridge 300 which can be attached to detached from the printer 100. Although not only the photoconductor 1 and the cleaning unit 20, but also the charging roller 3 and the developing device 6 are integrally provided in the process cartridge 300 shown in FIG. 21, the process cartridge 300 in which at least the photoconductor 1 and the cleaning unit 20 are integrally provided is applicable.

Examples of employing the cleaning unit 20 according to exemplary embodiments in a color printer are described in detail below with reference to FIGS. 22, 23, and 24. Some elements or components of each color printer shown in FIGS. 22, 23, and 24 may have the same functions as those in the printer 100 of FIG. 1 and the descriptions thereof are omitted here.

Figure 22:
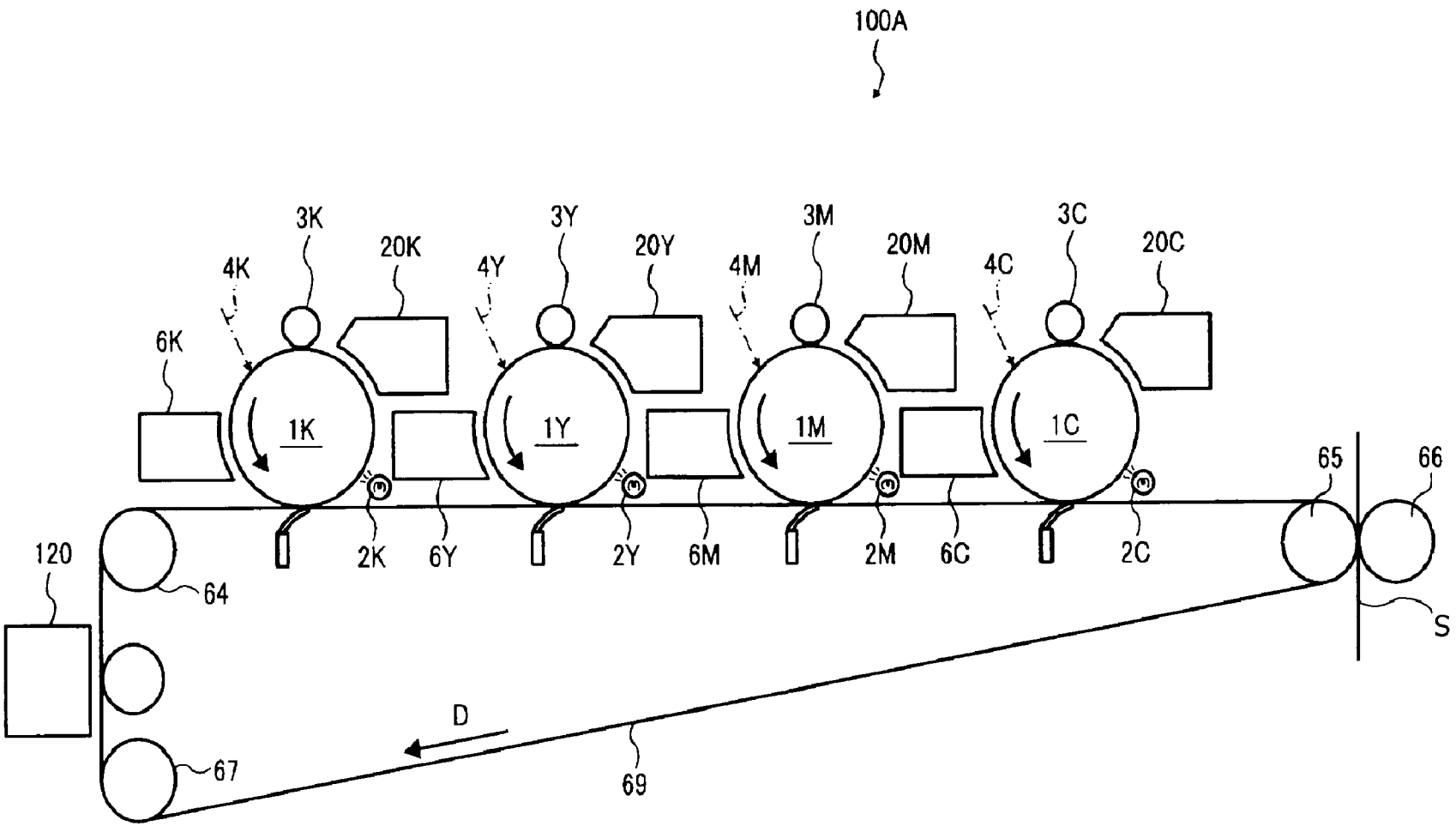
FIG. 22 is a schematic configuration of a main portion of a tandem-type full-color image forming apparatus.

FIG. 22 is a schematic view illustrating a configuration of a tandem type full-color image forming apparatus or printer 100A in which the cleaning unit 20 according to exemplary embodiments is employed.

The tandem type full-color printer 100A includes an intermediate transfer belt 69 tightly stretched across a plurality of supporting rollers 64, 65, and 67, such that a horizontal length of the tandem type full-color printer 100A is longer than a vertical length thereof when the tandem type full-color printer 100A is installed on a horizontal surface. The intermediate transfer belt 69 is driven in a direction indicated by arrow D in FIG. 22. Four photoconductors 1K, 1Y, 1M, and 1C (hereinafter collectively referred to as the "photoconductor 1") are aligned on a horizontally stretched portion of the intermediate transfer belt 69. Charging rollers 3K, 3Y, 3M, and 3C (hereinafter collectively referred to as the "charging roller 3"), the developing units 6K, 6Y, 6M, and 6C (hereinafter collectively referred to as the "developing unit 6"), cleaning units 20K, 20Y, 20M, and 20C (hereinafter collectively referred to as the "cleaning unit 20"), and so forth, are provided around the photoconductor 1, respectively. The tandem type full-color printer 100A further includes a sheet feeding cassette, not shown, in which a plurality of transfer sheets S is stored. A sheet feeding roller, not shown, feeds the transfer sheet S sheet by sheet from the sheet feeding cassette, and the transfer sheet S is conveyed to a secondary transfer area between a secondary transfer roller 66 and the intermediate transfer belt 69 at a timing controlled by a pair of registration rollers, not shown.

When image forming processes are started in the tandem type full-color printer 100A, the photoconductor 1 is rotated in a counterclockwise direction, and the intermediate transfer belt 69 is driven in the direction indicated by the arrow D in FIG. 22. After the charging roller 3 has evenly charged the surface of the photoconductor 1, laser beams 4K, 4Y, 4M, and 4C (hereinafter collectively referred to as the "laser beam 4"), which are modulated with image data of each color, are irradiated to the surface of the photoconductor 1 to form electrostatic latent images of black, yellow, magenta, and cyan, on the surface of the photoconductor 1, respectively. Subsequently, the developing unit 6 develops the electrostatic latent images of each color with toners of corresponding colors to form toner images of each color.

Obtained toner images of each color are primarily transferred onto the intermediate transfer belt 69 such that the toner images are superimposed on one another. The superimposed toner images are transferred by the secondary transfer roller 66 onto the transfer sheet S conveyed to the secondary transfer area. The transfer sheet S having a transferred toner image thereon is conveyed to a fixing unit, not shown. In the fixing unit, heat and pressure are applied to the transfer sheet S to fix the toner image onto the transfer sheet S.

After fixing has been performed, the transfer sheet S is discharged to a discharge tray, not shown. The residual toner particles on the surface of the photoconductor 1 after transfer has been performed are removed by the cleaning unit 20. The residual toner particles on the surface of the intermediate transfer belt 69 are removed by an intermediate transfer belt cleaning unit 120. The same configuration as the cleaning unit 20 according to the present invention can also be applied to the intermediate transfer belt cleaning device 120.

After the image forming operation is completed, electrical discharging lamps 2K, 2Y, 2M, and 2C (hereinafter collectively referred to as the "electrical discharging lamp 2") discharge the charge on the photoconductor 1 so that the photoconductor 1 can be ready for a subsequent image forming operation.

Even if toner particles having a spherical shape are used in the tandem type full-color printer 100A shown in FIG. 22, the residual toner particles can be removed from the surfaces of the photoconductor 1 by using the cleaning unit 20. Moreover, when most of the residual toner particles may have the positive polarity or the negative polarity depending on environmental changes, the cleaning unit 20 may remove the residual toner particles from the surface of the photoconductor 1.

Further, the residual toner can be satisfactorily removed from the surface of the intermediate transfer belt 69 even if the toner is the spherical toner using the intermediate transfer belt cleaning unit 120 serving as a cleaning unit for the intermediate transfer belt that cleans the residual toner remaining on the surface of the intermediate transfer belt 69 without being transferred to the transfer sheet S.

Further, even if the polarity of most of the residual toner on the intermediate transfer belt 69 is changed to the positive polarity or to the negative polarity due to a change of the environment, the residual toner can excellently be removed from the intermediate transfer belt 69.

Figure 23:
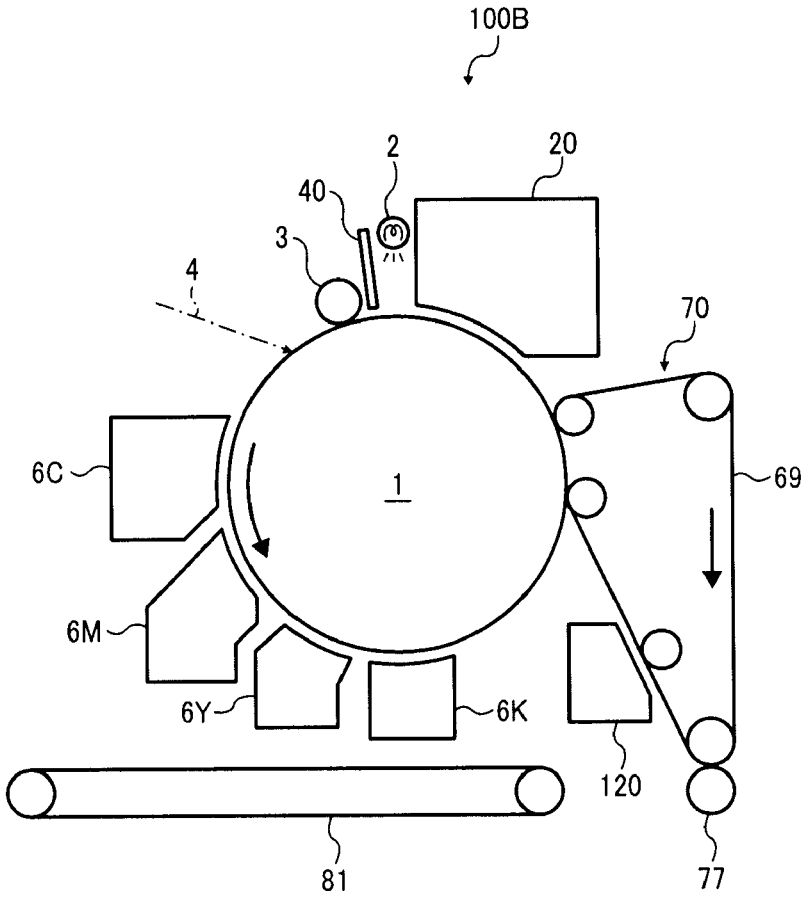
FIG. 23 is a schematic configuration of a main portion of a one-drum-type full-color image forming apparatus.

FIG. 23 is a schematic view illustrating a configuration of a one-drum type full-color image forming apparatus or printer 100B in which the cleaning unit 20 according to exemplary embodiments of the present invention is employed. The one-drum type full-color printer 100B includes the photoconductor 1 in a housing of the main body, not shown. Various image forming components are arranged around the photoconductor 1, for example, the charging roller 3 as a charging unit, the developing units 6C, 6M, 6Y, and 6K corresponding to the colors of cyan (C), magenta (M), yellow (Y), and black (K), respectively, an intermediate transfer unit 70, and the cleaning unit 20. Further, the one-drum type full-color printer 100B includes a sheet feeding cassette, not shown, that stores transfer sheets S as recording media. The transfer sheets in the sheet feeding cassette are fed by a sheet feeding roller, not shown, sheet by sheet, and a timing of each sheet is adjusted by a pair of registration rollers, not shown, and then the transfer sheet S is fed to a secondary transfer area formed between a secondary transfer unit 77 and the intermediate transfer unit 70.

When an image is formed using the one-drum type full-color printer 100B of FIG. 23, the photoconductor 1 is made to rotate in the counterclockwise direction in FIG. 23 and the intermediate transfer belt 69 of the intermediate transfer unit 70 is made to rotate in the clockwise direction of FIG. 23. Then, the surface of the photoconductor 1 is uniformly charged by the charging roller 3 and is irradiated with a laser beam 4 modulated based on image data for C toner, and a C-electrostatic latent image is formed on the surface of the photoconductor 1. The C-electrostatic latent image is developed using C-toner by the developing unit 6C. A C-toner image obtained in the above-described manner is primarily transferred to the intermediate transfer belt 69 of the intermediate transfer unit 70. Thereafter, the residual toner remaining on the surface of the photoconductor 1 is removed by the cleaning unit 20, and then, the surface of the photoconductor 1 is again uniformly charged by the charging roller 3.

Then, the surface of the photoconductor 1 is irradiated with the laser beam 4 modulated based on image data for M toner, and an M-electrostatic latent image is formed on the surface of the photoconductor 1. The M-electrostatic latent image is developed using M-toner by the developing unit 6M. An M-toner image obtained in the above-described manner is primarily transferred onto the intermediate transfer belt 69 so as to be superimposed on the C-toner image already transferred onto the intermediate transfer belt 69. Hereinafter, A Y-toner image and a K-toner image are obtained similarly to the above-described operation and are primarily transferred onto the intermediate transfer belt 69. The toner images on the intermediate transfer belt 69 in a state of their mutually superimposed on one another obtained in the above-described manner are transferred by the secondary transfer unit 77 onto the transfer sheet conveyed to the secondary transfer area.

The one-drum type full-color printer 100B of FIG. 23 further includes the electrical discharging lamp 2 for discharging the charge on the photoconductor 1 after the completion of the image forming operation, so that the photoconductor 1 can be ready for a subsequent image forming operation, and the light shielding plate 40 for shielding light emitted from the electrical discharge lamp 2.

The transfer sheet S to which the toner images are transferred in the above-described manner is conveyed to a fixing unit, not shown, by a sheet conveying belt 81. The transfer sheet S is heated and pressed by the fixing unit to fix the toner images on the transfer sheet S. The transfer sheet S with the fixed toner images are discharged onto a sheet discharging tray, not shown. The residual toner remaining on the surface of the photoconductor 1 after the toner images are transferred is removed by the cleaning unit 20. By contrast, the residual toner remaining on the surface of the intermediate transfer belt 69 is removed by the intermediate transfer belt cleaning unit 120. The same configuration as the cleaning unit 20 according to the present invention can also be applied to the intermediate transfer belt cleaning unit 120.

The one-drum type full-color printer 100B shown in FIG. 23 can substantially remove the residual toner from the surface of the photoconductor 1, even if the toner is spherical, by using the cleaning unit 20 that cleans the residual toner remaining on the surface of the photoconductor 1. Further, even if the polarity of most of the residual toner is changed to the positive polarity or to the negative polarity due to a change of the environment, the residual toner can substantially be removed from the photoconductor 1. Further, the residual toner can be satisfactorily removed from the surface of the intermediate transfer belt 69, even if the toner is spherical, by using the intermediate transfer belt cleaning unit 120 that removes the residual toner remaining on the surface of the intermediate transfer belt 69 without being transferred onto the transfer sheet S. Further, even if the polarity of most of the residual toner on the intermediate transfer belt 69 is changed to the positive polarity or to the negative polarity due to a change of environment, the residual toner can substantially be removed from the intermediate transfer belt 69.

Figure 24:
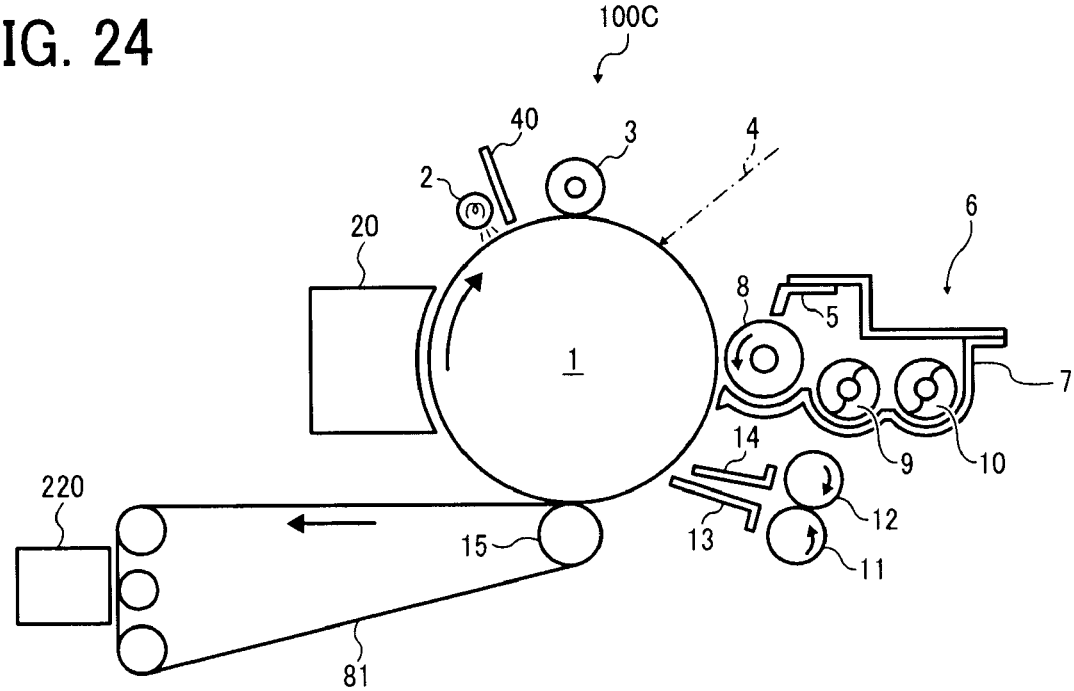
FIG. 24 is a schematic configuration of a main portion of an image forming apparatus in which a cleaning unit is provided for a sheet conveyor belt.

FIG. 24 is a schematic view illustrating a configuration of an image forming apparatus or printer 100C in which the cleaning unit 20 according to exemplary embodiments of the present invention is employed. The cleaning unit 20 provided to the printer 100C has the same configuration as that of the cleaning unit 20 of any printer of the printers 100, 100A, and 100B to be used as a conveying belt cleaning unit that removes toner adhering to the sheet conveyor belt 81.

If paper jam occurs in the printer 100C shown in FIG. 24, the toner image on the photoconductor 1 is transferred onto the sheet conveyor belt 81, which causes the sheet conveyor belt 81 to be contaminated. Further, there is a case where toner with a low amount of charge or positively charged toner in the developing roller 8 may adhere to a space between sheets on the photoconductor 1. The toner adhering to the space between the transfer sheets is transferred to the sheet conveying belt 81 to cause the sheet conveyor belt 81 to be contaminated. Part of the toner adhering to the sheet conveying belt 81 due to the paper jam or the like is injected with charge by the transfer roller 15 and the polarity of the toner is reversed. As a result, the toner as dust transferred onto the sheet conveying belt 81 is a mixture of toner with the positive polarity and toner with the negative polarity. However, by using a conveying belt cleaning unit 220 having the same configuration as the cleaning unit 20 according to the present invention, the toner in which the positive polarity and the negative polarity are mixed on the sheet conveyor belt 81 can be substantially removed.

According to the above-described exemplary embodiments, one advantage of the present invention is that the cleaning unit 20 can operate at a lower voltage (e.g., lower power consumption, less mechanical wear and tear, and longer service life) and maintain good cleaning performance of the polarity control blade 22. The cleaning unit 20 includes the cleaning brush 23 serving as a cleaning member, the polarity control blade 22 serving as an elastic blade, the blade holder 21 serving as a blade supporting member, and the blade power source 29. The cleaning brush 23 contacts the photoconductor 1 that serves as a target member including a surface that moves in a given direction and removes residual toner remaining on the surface of the photoconductor 1 by the voltage applied thereto. The polarity control blade 22 is conductive and contacts the surface of the photoconductor 1 at an upstream position from the cleaning brush 23 contacting the photoconductor 1 in a direction of movement of the surface of the photoconductor 1. The blade holder 21 fixedly supports the polarity control blade 22 to the main body of the cleaning unit 20. The blade power source 29 applies a voltage to the polarity control blade 22 via the blade holder 21.

The residual toner on the surface of the photoconductor 1 passes a portion between the polarity control blade 22 and the photoconductor 1 facing each other to be charged to the same polarity as the voltage applied to the polarity control blade 22, and is then electrostatically removed from the surface of the photoconductor 1 by the cleaning brush 23.

The cleaning unit 20 further includes the conductive tape 38 serving as a conductive member. The conductive tape 38 has conductivity greater than that of the polarity control blade 22 and electrically connects the blade holder 21 and the polarity control blade 22. Further, the conductive tape 38 is deformable according to deformation of the polarity control blade 22 while being fixedly attached to the surface of the polarity control blade 22.

The conductive tape 38 is attached to the polarity control blade 22 so that a distance to the edge part 22*a* of the polarity control blade 22, the edge part 22*a* being located on the surface facing and contacting the surface of the photoconductor 1, is closer from the edge part 38*a* of the conductive tape 38 attached on the surface of the polarity control blade 22 than from the edge part 21*a* of the blade holder 21, the edge part 21*a* being located on the surface having the edge part 22*a* of the polarity control blade 22. By disposing the edge part 38*a* of the conductive tape 38, which serves as an electrode, to be closer to the edge part 22*a* of the polarity control blade 22 as described above, the electrode distance L2 that is the distance from the edge part 38*a* of the conductive tape 38 to the edge part 22*a* of the polarity control blade 22 can be reduced without reducing the overhang length L1 that is a length of the free length part. Since the overhang length L1 of the polarity control blade 22 is not reduced, the cleaning performance of the polarity control blade 22 can be maintained, and by locating the edge part 38*a* of the conductive tape 38 closer to where the edge part 22*a* of the polarity control blade 22 contacts the surface of the photoconductor 1, the voltage applied to the polarity control blade 22 can be reduced.

Further, as shown in FIG. 10, when the edge part 38*a* of the conductive tape 38 is attached to the surface 22*f* of the polarity control blade 22 facing the surface of the photoconductor 1, the distance that affects to the surface resistance can be reduced by a degree of the thickness of the polarity control blade 22. Accordingly, the voltage applied to the polarity control blade 22 by the blade power source 29 can be reduced.

Further, by using the conductive tape 38 as a conductive member and attaching the conductive tape 38 to the surface of the polarity control blade 22 at the same time contacting to the blade holder 21, the cleaning performance can be maintained with a simple configuration and the voltage applied to the polarity control blade 22 can be reduced.

Further, by using the spherical toner, the image quality can be increased and the cleaning unit 20 can perform good cleaning operation by effectively removing the spherical toner that is generally more difficult than pulverized toner when using a mechanical cleaning method.

Further, the spherical toner has high circularity with the shape factor "SF-1" in a range from approximately 100 to approximately 150. When a shape of the toner particle becomes close to a sphere, toner particles contact each other as well as the photoconductor 1 in a point contact manner. Consequently, absorbability between the toner particles decreases, resulting in an increase in fluidity. Moreover, absorbability between the toner particles and the photoconductor 1 decreases, resulting in an increase in a transfer rate and high quality images.

Further, the cleaning unit 20 according to the above-described exemplary embodiment of the present invention can be employed as the image carrier cleaning unit to remove the residual toner remaining on the photoconductor 1 after the transfer operation and effectively clean the photoconductor 1 serving as an image carrier included in the printer 100. The above-described actions can achieve the image forming operation for high quality images.

Further, the cleaning unit 20 according to the above-described exemplary embodiment of the present invention can be employed as the image carrier cleaning unit when the printer 100 corresponds to a full-color image forming apparatus with one drum photoconductor. The cleaning unit 20 can provide good cleaning performance for removing the residual toner on the photoconductor 1. This can prevent the residual toner on the photoconductor 1 to be mixed into the developing unit 6 containing a different toner color. Accordingly, the cleaning unit 20 can achieve the image forming operation for high quality images.

Further, the cleaning unit 20 according to the above-described exemplary embodiment of the present invention can be employed as the image carrier cleaning unit when the printer 100 corresponds to a tandem-type, full-color image forming apparatus with multiple photoconductors. The cleaning unit 20 can provide good cleaning performance for removing the residual toner on the photoconductor 1. Accordingly, the cleaning unit 20 can achieve the image forming operation for high quality images.

Further, the intermediate transfer belt cleaning unit 120, according to an exemplary embodiment of the present invention, having the same configuration as the cleaning unit 20 can be employed as an intermediate transfer member cleaning unit that cleans the intermediate transfer belt 69 serving as an intermediate transfer member. The intermediate transfer belt cleaning unit 120 can provide good cleaning performance for removing the residual toner on the intermediate transfer belt 69. This can prevent the residual toner on the intermediate transfer belt 69 to adhere to the photoconductor 1 for a different toner color. Accordingly, the intermediate transfer belt cleaning unit 120 can achieve the image forming operation for high quality images.

Further, the transfer belt cleaning unit 220, according to an exemplary embodiment of the present invention, having the same configuration as the cleaning unit 20 can be employed as a recording medium conveying member cleaning unit that cleans the sheet conveying belt 81 serving as a recording medium conveying member to convey the transfer sheet serving as a recording medium. The transfer belt cleaning unit 220 can provide good cleaning performance for removing the residual toner on the sheet conveying belt 81. Accordingly, the transfer belt cleaning unit 220 can prevent contamination on the back side of the transfer sheet.

Further, the photoconductor 1 includes a material having a filler dispersed to either of a surface layer or a photoconductive layer. By using the photoconductor 1 having such material, the amount of scrape of the surface film of the photoconductor 1 can be reduced, which can increase wear resistance. The increase in wear resistance can prevent the photoconductor 1 from wearing and scraping to cause the surface thereof to be uneven. As a result, the contact pressure between the photoconductor and the cleaning blade can be maintained in an axial direction of the photoconductor. This can avoid an occurrence of a portion having a low contact pressure between the photoconductor and the cleaning blade, which can reduce the toner falling from the portion.

Further, the photoconductor 1 corresponds to an organic photoconductor including the surface layer coated by the filler or using an organic photoconductive element based on a cross-linking type charge transport material. Therefore, the amount of scrape of the surface film of the photoconductor 1 can be reduced.

Further, the photoconductor 1 includes a photoconductive layer formed by amorphous silicon. By using such photoconductive layer, the amount of scrape of the surface film of the photoconductor 1 can be reduced to increase wear resistance. The increase in wear resistance can prevent the photoconductor 1 from wearing and scraping to cause the surface thereof to be uneven. As a result, the contact pressure between the photoconductor and the cleaning blade can be maintained in an axial direction of the photoconductor. This can avoid an occurrence of a portion having a low contact pressure between the photoconductor and the cleaning blade, which can reduce the toner falling from the portion.

Further, the photoconductor 1 and the cleaning unit 20 are integrally mounted on the process cartridge 300, so that the photoconductor 1 and the cleaning unit 20 can be easily detached from or attached to the printer 100. Accordingly, the performance in replacement of image forming unit can be enhanced.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. A cleaning unit, comprising:

a cleaning member disposed in contact with a surface of a target member and supplied with a given voltage, with the cleaning member configured to remove residual toner remaining on the surface of the target member by an electrostatic force generated due to the voltage applied to the cleaning member;

a conductive elastic blade disposed in contact with the surface of the target member upstream from the cleaning member in a direction of movement of the surface of the target member;

a conductive blade supporting member configured to fixedly support the conductive elastic blade to a main body of the cleaning unit;

a blade power source configured to apply a given voltage to the conductive elastic blade via the blade supporting member, and to charge the residual toner to a same polarity as the voltage applied to the elastic blade while the residual toner passing between the elastic blade and the target member is removed electrostatically from the target member; and a conductive member having conductivity greater than that of the elastic blade, configured to electrically connect the blade supporting member and the elastic blade and deform with the elastic blade while being fixedly attached to a surface of the elastic blade, the conductive member being disposed so that an edge part of the conductive member is closer to where the elastic blade contacts the target member than an edge part of the blade supporting member.

2. The cleaning unit according to claim 1, wherein the edge part of the conductive member is formed on the surface of the elastic blade facing the target member.

3. The cleaning unit according to claim 1, wherein the conductive member includes conductive tape attached to the surface of the elastic blade to contact the blade supporting member.

4. The cleaning unit according to claim 1, wherein the residual toner has a shape factor "SF-1" ranging from approximately 100 to approximately 150.

5. An image carrier unit detachably attachable to an image forming apparatus, the image carrier unit comprising:

the cleaning unit according to claim 1; and an image carrier configured to serve as the target member, the cleaning unit and the image carrier being integrally provided as a single integrated unit thereto.

6. The image carrier unit according to claim 5, wherein the edge part of the conductive member is disposed on the contact surface of the elastic blade facing the target member.

7. The image carrier unit according to claim 5, wherein the conductive member includes conductive tape attached to the surface of the elastic blade to contact the blade supporting member.

8. The image carrier unit according to claim 5, wherein the residual toner has a shape factor "SF-1" ranging from approximately 100 to approximately 150.

9. An image forming apparatus, comprising:

an image carrier configured to carry an image on a surface thereof;

a charging unit configured to charge the surface of the image carrier;

a latent image forming unit configured to form an electrostatic latent image on the surface of the image carrier;

a developing unit configured to develop the electrostatic latent image formed on the image carrier to a toner image;

a transfer unit configured to transfer the toner image on the image carrier onto one of a transfer member and a recording medium;

an image carrier cleaning unit configured to remove residual toner remaining on the surface of the image carrier serving as a target member to be cleaned; and the cleaning unit according to claim 1.

10. The image forming apparatus according to claim 9, wherein the image carrier includes a photoconductive layer formed of amorphous silicon.

11. The image forming apparatus according to claim 9, wherein the image carrier includes a material having a filler dispersed in a layer thereof.

12. The image forming apparatus according to claim 9, wherein the image carrier uses an element based on a cross-linking type charge transport material.

13. The image forming apparatus according to claim 9, wherein the image carrier includes a surface layer thereof reinforced with filler.

* * * * *